US012276167B2

(12) United States Patent
Massey

(10) Patent No.: US 12,276,167 B2
(45) Date of Patent: Apr. 15, 2025

(54) DOWNHOLE APPARATUS

(71) Applicant: Impact Selector International, LLC, Heath, TX (US)

(72) Inventor: James Patrick Massey, Leadville, CO (US)

(73) Assignee: Weatherford Technology Holdings, LLC, Houston, TX (US)

( * ) Notice: Subject to any disclaimer, the term of this patent is extended or adjusted under 35 U.S.C. 154(b) by 217 days.

(21) Appl. No.: 18/182,722

(22) Filed: Mar. 13, 2023

(65) Prior Publication Data

US 2023/0287748 A1 Sep. 14, 2023

Related U.S. Application Data

(60) Provisional application No. 63/269,331, filed on Mar. 14, 2022.

(51) Int. Cl.
*E21B 23/04* (2006.01)

(52) U.S. Cl.
CPC ..... *E21B 23/0414* (2020.05)

(58) Field of Classification Search
CPC ..... E21B 23/0414
See application file for complete search history.

(56) References Cited

U.S. PATENT DOCUMENTS

| | | | |
|---|---|---|---|
| 6,651,747 | B2 | 11/2003 | Chen et al. |
| 2003/0047312 | A1 | 3/2003 | Bell |
| 2014/0338910 | A1 | 11/2014 | Bell et al. |
| 2018/0258724 | A1 | 9/2018 | Massey et al. |

FOREIGN PATENT DOCUMENTS

| | | | |
|---|---|---|---|
| WO | 2018/227199 | A1 | 12/2018 |
| WO | 2018/227199 | A4 | 12/2018 |

OTHER PUBLICATIONS

PCT/US2023/064226 International Search Report and The Written Opinion of the International Searching Authority , 12 bages, dated May 23, 2023.

*Primary Examiner* — Kristyn A Hall
(74) *Attorney, Agent, or Firm* — Boisbrun Hofman, PLLC

(57) ABSTRACT

An explosive assembly for a downhole tool operable to connect and selectively disconnect within a wellbore a first portion of a downhole tool string and a second portion of the downhole tool string. The explosive assembly includes an explosive charge, a detonator switch operable to detonate the explosive charge, and a housing assembly containing the explosive charge and the detonator switch. The explosive assembly may be movable as a single unit and installable within an internal space of the downhole tool. The explosive charge may be operable to sever a support member of the downhole tool when the explosive charge is detonated by the detonator switch to therefore disconnect a first portion of the downhole tool and a second portion of the downhole tool from each other and thus disconnect the first portion of the downhole tool string and the second portion of the downhole tool string from each other.

20 Claims, 7 Drawing Sheets

DOWNHOLE APPARATUS

CROSS-REFERENCE TO RELATED APPLICATIONS

This application claims priority to and the benefit of U.S. Provisional Patent Application No. 63/269,331, entitled "DOWNHOLE APPARATUS," filed Mar. 14, 2022, the entire disclosure of which is hereby incorporated herein by reference.

BACKGROUND OF THE DISCLOSURE

Wells are generally drilled into land surface or ocean bed to recover natural deposits of oil, gas, and other natural resources that are trapped in subterranean geological formations in the Earth's crust. Testing and evaluation of completed and partially finished wells has become commonplace, such as to increase well production and return on investment. Downhole measurements of formation pressure, formation permeability, and recovery of formation fluid samples, may be useful for predicting economic value, production capacity, and production lifetime of geological formations. Completion and stimulation operations of wells, such as perforating and fracturing operations, may also be performed to optimize well productivity. Plugging and perforating tools may be utilized to set plugs within a wellbore to isolate portions of the wellbore and subterranean geological formations surrounding the wellbore from each other and to perforate the well in preparation for fracturing. Each fracturing stage interval along the wellbore can be perforated with one or more perforating tools forming one or more clusters of perforation tunnels along the wellbore. Intervention operations in completed wells, such as installation, removal, or replacement of various production equipment, may also be performed as part of well repair or maintenance operations or permanent abandonment. Such testing, completion, intervention, and other downhole operations have become complicated, as wellbores are drilled deeper and often include extensive non-vertical portions and bends. Consequently, in working with deeper and more complex wellbores, it has become more likely that downhole tools, tool strings, tubulars, and other downhole equipment may become stuck within the wellbore.

A downhole tool, such as an impact or jarring tool, may be utilized to dislodge a tool string or other equipment when it becomes stuck within a wellbore. The impact tool may be included as part of the tool string and deployed downhole or the impact tool may be deployed after the tool string becomes stuck. Tension may be applied from a wellsite surface to the deployed impact tool via a wireline or other conveyance line utilized to deploy the impact tool to generate elastic energy. After sufficient tension is applied, the impact tool may be triggered to release the elastic energy and deliver an impact intended to dislodge the stuck tool string.

If an impact tool is not able to dislodge the stuck tool string, a release tool included along the stuck tool string may be operated to disconnect a free portion of the tool string from a stuck portion of the tool string. The release tool may be operated, for example, by applying tension from the wellsite surface via the conveyance line to break a shear pin of the release tool to uncouple an upper portion of the release tool from a lower portion of the release tool and, thus, uncouple the free portion of the tool string from the stuck portion of the tool string. After the free portion of the tool string is disconnected from the stuck portion, the free portion may be removed to the wellsite surface. Fishing equipment may then be conveyed downhole to couple with and retrieve the stuck portion of the tool string. However, in some downhole applications, such as in deviated wellbores or when multiple bends are present along the wellbore, friction between a sidewall of the wellbore and the conveyance line may reduce or prevent adequate tension from being applied to the tool string and the release tool therein to break the shear pin or otherwise uncouple and separate the upper and lower portions of the release tool and, thus, disconnect the free and stuck portions of the tool string from each other.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
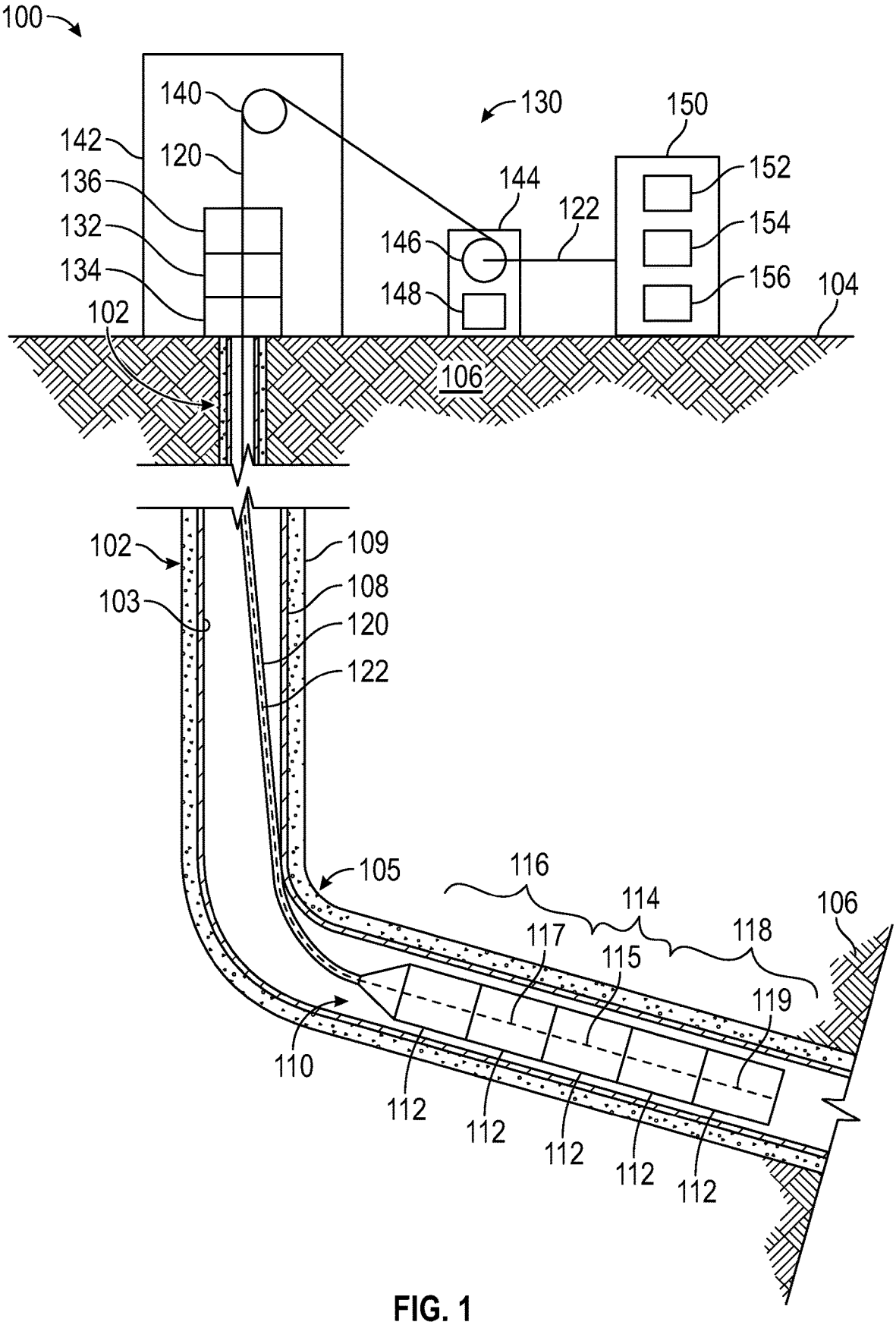
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows, may include embodiments in which the first and second features are formed in direct contact, and may also include embodiments in which additional features may be formed interposing the first and second features, such that the first and second features may not be in direct contact.

Furthermore, terms, such as upper, upward, above, lower, downward, and/or below are utilized herein to indicate relative positions and/or directions between apparatuses, tools, components, parts, portions, members and/or other elements described herein, as shown in the corresponding figures. Such terms do not necessarily indicate relative positions and/or directions when actually implemented.

Such terms, however, may indicate relative positions and/or directions with respect to a wellbore when an apparatus according to one or more aspects of the present disclosure is utilized or otherwise disposed within the wellbore. For example, the terms upper and upward may mean in the uphole direction or uphole from, and the terms lower and downward may mean in the downhole direction or downhole from.

FIG. 1 is a schematic view of at least a portion of an example implementation of a wellsite system 100 according to one or more aspects of the present disclosure, representing an example environment in which one or more aspects of the present disclosure may be implemented. The wellsite system 100 is depicted in relation to a wellbore 102 formed by rotary and/or directional drilling and extending from a wellsite surface 104 into a subterranean formation 106. A lower portion of the wellbore 102 is shown enlarged compared to an upper portion of the wellbore 102 adjacent the wellsite surface 104 to permit a larger and therefore a more detailed depiction of various tools, tubulars, devices, and other objects disposed within the wellbore 102. The wellsite system 100 may be utilized to facilitate recovery of oil, gas, and/or other materials that are trapped in the subterranean formation 106 via the wellbore 102. At least a portion of the wellbore 102 may be a cased-hole wellbore 102 comprising a casing 108 secured by cement 109, and/or a portion of the wellbore 102 may be an open-hole wellbore 102 lacking the casing 108 and cement 109. The wellbore 102 may also or instead contain a fluid conduit (e.g., a production tubing) (not shown) disposed within at least a portion of the casing 108 and/or an open-hole portion of the wellbore 102. Thus, one or more aspects of the present disclosure are applicable to and/or readily adaptable for utilizing in a cased-hole portion of the wellbore 102, an open-hole portion of the wellbore 102, and/or a fluid conduit disposed within a cased-hole and/or open-hole portion of the wellbore 102. It is also noted that although the wellsite system 100 is depicted as an onshore implementation, it is to be understood that the aspects described below are also generally applicable to offshore implementations.

The wellsite system 100 includes surface equipment 130 located at the wellsite surface 104. The wellsite system 100 also includes or is operable in conjunction with a downhole intervention and/or sensor assembly, referred to as a downhole tool string 110, conveyed within the wellbore 102 along one or more subterranean formations 106 via a conveyance line 120 operably coupled with one or more pieces of the surface equipment 130. The conveyance line 120 may be operably connected with a conveyance device 140 operable to apply an adjustable downward- and/or upward-directed force to the tool string 110 via the conveyance line 120 to convey the tool string 110 within the wellbore 102. The conveyance line 120 may be or comprise coiled tubing, a cable, a wireline, a slickline, a multiline, or an e-line, among other examples. The conveyance device 140 may be, comprise, or form at least a portion of a sheave or pulley, a winch, a draw-works, an injector head, and/or other device coupled to the tool string 110 via the conveyance line 120. The conveyance device 140 may be supported above the wellbore 102 via a mast, a derrick, a crane, and/or other support structure 142. The surface equipment 130 may further comprise a reel or drum 146 configured to store thereon a wound length of the conveyance line 120, which may be selectively wound and unwound by the conveyance device 140 to selectively convey the tool string 110 into, along, and out of the wellbore 102.

Instead of or in addition to the conveyance device 140, the surface equipment 130 may comprise a winch conveyance device 144 comprising or operably connected with the drum 146. The drum 146 may be rotated by a rotary actuator 148 (e.g., an electric motor) to selectively unwind and wind the conveyance line 120 to apply an adjustable tensile force to the tool string 110 to selectively convey the tool string 110 into, along, and out of the wellbore 102.

The conveyance line 120 may comprise metal tubing, support wires, and/or cables configured to support the weight of the downhole tool string 110. The conveyance line 120 may also comprise one or more insulated electrical and/or optical conductors 122 operable to transmit electrical energy (i.e., electrical power) and electrical and/or optical signals (e.g., sensor data, control data, etc.) between the tool string 110 and one or more components of the surface equipment 130, such as a power and control system 150. The conveyance line 120 may comprise and/or be operable in conjunction with a means for communication between the tool string 110, the conveyance device 140, the winch conveyance device 144, and/or one or more other portions of the surface equipment 130, including the power and control system 150.

The wellbore 102 may be capped by a plurality (e.g., a stack) of fluid control devices 132, such as fluid control valves, spools, and fittings individually and/or collectively operable to direct and control the flow of fluid out of the wellbore 102. The fluid control devices 132 may also or instead comprise a blowout preventer (BOP) stack operable to prevent the flow of fluid out of the wellbore 102. The fluid control devices 132 may be mounted on top of a wellhead 134.

The surface equipment 140 may further comprise a sealing and alignment assembly 136 mounted on the fluid control devices 132 and operable to seal the conveyance line 120 during deployment, conveyance, intervention, and other wellsite operations. The sealing and alignment assembly 136 may comprise a lock chamber (e.g., a lubricator, an airlock, a riser, etc.) mounted on the fluid control devices 132, a stuffing box operable to seal around the conveyance line 120 at top of the lock chamber, and return pulleys operable to guide the conveyance line 120 between the stuffing box and the drum 146, although such details are not shown in FIG. 1. The stuffing box may be operable to seal around an outer surface of the conveyance line 120, for example via annular packings applied around the surface of the conveyance line 120 and/or by injecting a fluid between the outer surfaces of the conveyance line 120 and an inner wall of the stuffing box. The tool string 110 may be deployed into or retrieved from the wellbore 102 via the conveyance device 140 and/or winch conveyance device 144 through the fluid control devices 132, the wellhead 134, and/or the sealing and alignment assembly 136.

The power and control system 150 (e.g., a control center) may be utilized to monitor and control various portions of the wellsite system 100. The power and control system 150 may be located at the wellsite surface 104 or on a structure located at the wellsite surface 104. However, the power and control system 150 may instead be located at a remote location from the wellsite surface 104. The power and control system 150 may include a source of electrical power 152, a control workstation 154 (i.e., a human machine interface (HMI)), and a surface controller 156 (e.g., a processing device or computer). The surface controller 156 may be communicatively connected with various equipment of the wellsite system 100, such as may permit the surface controller 156 to monitor operations of one or more portions of the wellsite system 100 and/or to provide control of one or more portions of the wellsite system 100, including the tool string 110, the conveyance device 140, and/or the winch conveyance device 144. The control workstation 154 may be communicatively connected with the surface controller 156 and may include input devices for receiving the control data from human wellsite personnel and output devices for displaying sensor data and other information to the human wellsite personnel. The surface controller 156 may be operable to receive and process sensor data or information from the tool string 110 and/or control data (i.e., control commands) entered to the surface controller 156 by the human wellsite personnel via the control workstation 154. The surface controller 156 may store executable computer programs and/or instructions and may be operable to implement or otherwise cause one or more aspects of methods, processes, and operations described herein based on the executable computer programs, the received sensor data, and the received control data.

The tool string 110 may be conveyed within the wellbore 102 to perform various downhole sampling, testing, intervention, and other downhole operations. The tool string 110 may further comprise one or more downhole tools 112 (e.g., devices, modules, etc.) operable to perform such downhole operations. The downhole tools 112 of the tool string 110 may each be or comprise an acoustic tool, a cable head, a casing collar locator (CCL), a cutting tool, a density tool, a depth correlation tool, a directional tool, an electrical power module, an electromagnetic (EM) tool, a fluid sampling tool, a formation logging tool, a formation measurement tool, a formation testing tool, a gamma ray (GR) tool, a gravity tool, a hydraulic power module, a jarring tool, a magnetic resonance tool, a mechanical interface tool, a monitoring tool, a neutron tool, a nuclear tool, a perforating tool, a photoelectric factor tool, a plug, a plug setting tool, a porosity tool, a power module, a ram, a reservoir characterization tool, a resistivity tool, a seismic tool, a stroker tool, a surveying tool, and/or a telemetry tool, among other examples also within the scope of the present disclosure.

One or more of the downhole tools 112 may be or comprise a downhole release tool 114 connected (or coupled) between the downhole tools 112 forming an upper (uphole) portion 116 of the tool string 110 and the downhole tools 112 forming a lower (downhole) portion 118 of the tool string 110. The release tool 114 may mechanically connect (or couple) the upper portion 116 of the tool string 110 and the lower portion 118 of the tool string 110 to each other to permit the tool string 110 to be conveyed within the wellbore 102. The release tool 114 may also be selectively operable to release, uncouple, part, or otherwise disconnect the upper portion 116 of the tool string 110 and the lower portion 118 of the tool string 110 from each other while the tool string 110 is conveyed within the wellbore 102. The release tool 114 may therefore permit the lower portion 118 of the tool string 110 connected below (downhole from) the release tool 114 to be left in the wellbore 102 and the upper portion 116 of the tool string 200 located above (uphole from) the release tool 114 to be retrieved to the wellsite surface 104. Accordingly, if a portion (e.g., the lower portion 118) of the tool string 110 is stuck within the wellbore 102 and the tool string 110 cannot be freed, the release tool 114 located above the stuck portion of the tool string 110 may be operated to release the free portion (e.g., the upper portion 116) of the tool string 110 such that it may be retrieved to the wellsite surface 104.

The release tool 114 may comprise at least one electrical conductor 115 extending therethrough. The upper portion 116 of the tool string 110 may comprise at least one electrical conductor 117 connected with the conductor 122 and in electrical communication with one or more components of the surface equipment 130 via the conductor 122. The lower portion 118 of the tool string 110 may comprise at least one electrical conductor 119 connected with the conductor 115 and in electrical communication with one or more components of the surface equipment 130 via the conductors 115, 117, 122. Thus, one or more of the downhole tools 112 of the upper portion 116, the lower portion 118, and the release tool 114 may be electrically connected with one or more components of the surface equipment 130, such as the power and control system 150, via the electrical conductors 115, 117, 119, 122. For example, the electrical conductors 115, 117, 119, 122 may transmit and/or receive electrical power, sensor data, and/or control data between the power and control system 150 and one or more of the downhole tools 112 of the upper portion 116, the lower portion 118, and the release tool 114. The electrical conductors 115, 117, 119, 122 may further facilitate electrical communication between two or more of the downhole tools 112 of the upper portion 116, the lower portion 118, and the release tool 114. Each electrical conductor 115, 117, 119 may be or comprise an electrical path comprising a plurality of interconnected electrical conductors, connectors, and/or interfaces collectively forming the electrical path extending through a corresponding portion 112, 114, 116, 118 of the tool string 110.

Although FIG. 1 depicts the tool string 110 comprising a single release tool 114 directly coupled between the tool string portions 116, 118, it is to be understood that the tool string 110 may include two, three, four, or more release tools 114, each coupled between one or more of the downhole tools 112 forming the tool string portions 116, 118. Furthermore, the tool string 110 may comprise a different number of tool string portions 116, 118, wherein each tool string portion 116, 118 may be directly and/or indirectly coupled with the release tool 114.

Figure 2:
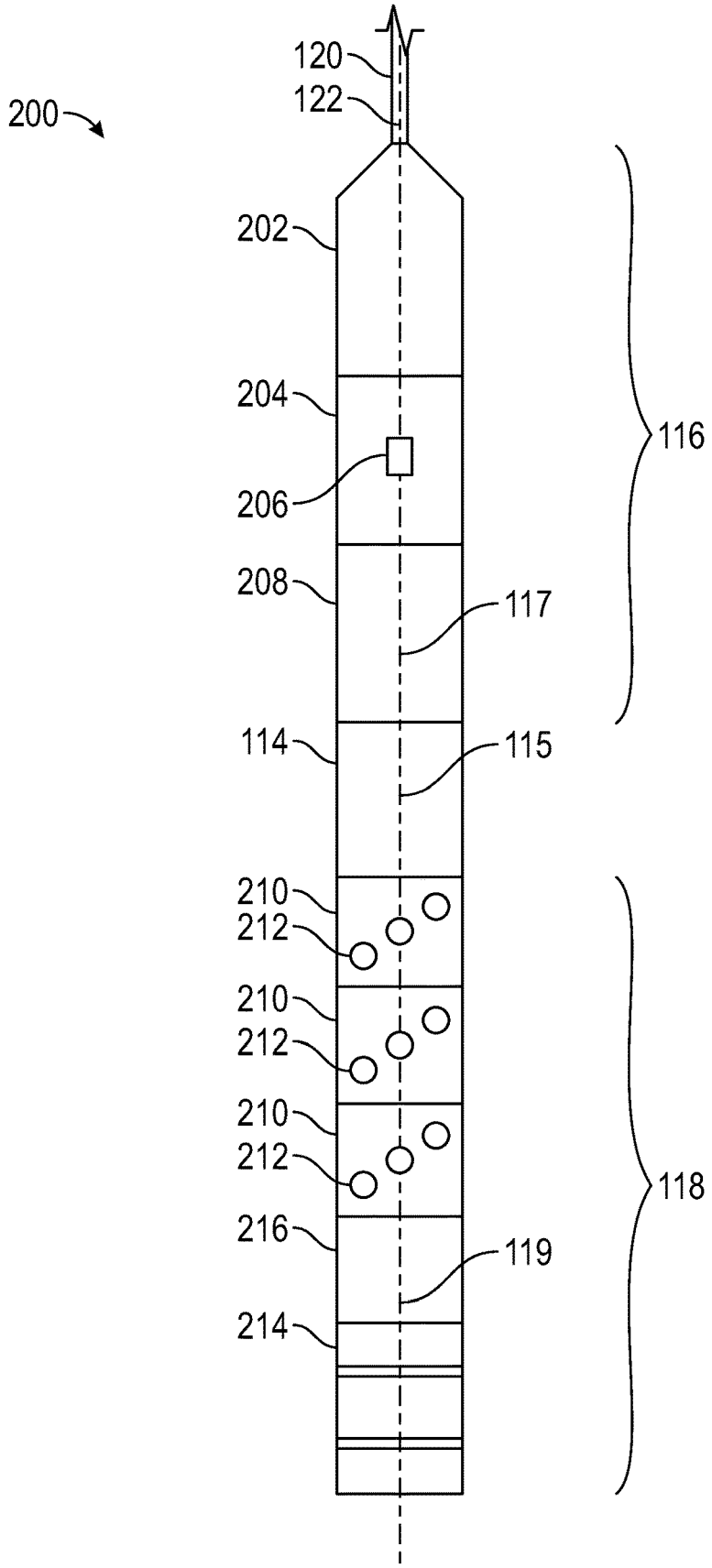
FIG. 2 is a schematic view of at least a portion of an example implementation of apparatus according to one or more aspects of the present disclosure.

FIG. 2 is a schematic side view of at least a portion of an example implementation of a tool string 200 according to one or more aspects of the present disclosure. The tool string 200 may be an example implementation of the tool string 110 described above and shown in FIG. 1 and may comprise one or more features and/or modes of operation of the tool string 110, including where indicated by like reference numerals. Accordingly, the following description refers to FIGS. 1 and 2, collectively.

The tool string 200 may comprise an upper portion 116, a lower portion 118, and a release tool 114 connected between the upper portion 116 of the tool string 200 and the lower portion 118 of the tool string 200. The release tool 114 may mechanically connect (or couple) the upper portion 116 and the lower portion 118 to each other to permit the tool string 200 to be conveyed within a wellbore 102. The release tool 114 may also be selectively operable to disconnect, uncouple, part, or otherwise release the upper portion 116 and the lower portion 118 from each other while the tool string 200 is conveyed within the wellbore 102. The release tool 114 may therefore permit the lower portion 118 of the tool string 200 connected below (downhole from) the release tool 114 to be left in the wellbore 102 and the upper portion 116 of the tool string 200 located above (uphole from) the release tool 114 to be retrieved to the wellsite surface 104. Accordingly, if a portion (e.g., the lower portion 118) of the tool string 200 is stuck within the wellbore 102 and the tool string 200 cannot be freed, such as via an impact tool included in the tool string 200, the release tool 114 located above the stuck portion of the tool string 200 may be operated to release the free portion (e.g., the upper portion 116) of the tool string 200 such that it may be retrieved to the wellsite surface 104. Although the tool string 200 is shown comprising a single release tool 114, it is to be understood that one or more additional release tools 114 may be coupled at other locations along the tool string 200, such as between other downhole tools of the tool string 200.

The release tool 114 may comprise at least one electrical conductor (or path) 115 extending therethrough. The upper portion 116 of the tool string 200 may comprise at least one electrical conductor (or path) 117 connected with the conductor 122 and in electrical communication with one or more components of the surface equipment 130 via the conductor 122. The lower portion 118 of the tool string 110 may comprise at least one electrical conductor (or path) 119 connected with the conductor 115 and in electrical communication with one or more components of the surface equipment 130 via the conductors 115, 117, 122. Thus, one or more of the downhole tools of the tool string 200 may be electrically connected with one or more components of the surface equipment 130, such as the power and control system 150, via the electrical conductors 115, 117, 119, 122. For example, the electrical conductors 115, 117, 119, 122 may transmit and/or receive electrical power, sensor data, and/or control data between the power and control system 150 and one or more of the downhole tools of the tool string 200.

The upper portion 116 of the tool string 200 may comprise a cable head 202, which may be operable to connect a conveyance line 120 with the tool string 200. The cable head 202 may be mechanically connected to the metal tubing, support wires, and/or cables of the conveyance line 120 and facilitate electrical and/or communicative connection between the conductor 122 of the conveyance line 120 with the rest of the tool string 200.

The upper portion 116 may further comprise a telemetry/control tool 204, such as may facilitate communication between the tool string 200 and the surface equipment 130 and/or control of one or more portions of the tool string 200. The telemetry/control tool 204 may comprise a downhole controller 206 communicatively connected with the power and control system 150, including the surface controller 156, via the conductors 117, 122 and with other portions of the tool string 200 via conductors 115, 117, 119, 122. The downhole controller 206 may be operable to receive, store, and/or process control commands from the power and control system 150 for controlling one or more portions of the tool string 200. The controller 206 may be further operable to store and/or communicate to the power and control system 150 sensor data generated by one or more sensors or instruments of the tool string 200. The telemetry/control tool 204 may further comprise inclination sensors and/or other sensors, such as one or more accelerometers, magnetometers, gyroscopic sensors (e.g., micro-electro-mechanical system (MEMS) gyros), and/or other sensors for determining the orientation of the tool string 200 relative to the wellbore 102. The telemetry/control tool 204 may further comprise a depth correlation tool, such as a casing collar locator (CCL) for detecting ends of casing collars by sensing a magnetic irregularity caused by the relatively high mass of an end of a collar of the casing 108. The correlation tool may also or instead be or comprise a gamma ray (GR) tool that may be utilized for depth correlation. The CCL and/or GR may be utilized to determine the position of the tool string 200 or portions thereof, such as with respect to known casing collar numbers and/or positions within the wellbore 102. Therefore, the CCL and/or GR tools may be utilized to detect and/or log the location of the tool string 200 within the wellbore 102, such as during deployment within the wellbore 102 or other downhole operations.

The upper portion 116 of the tool string 200 may further comprise an impact (or jarring) tool 208 operable to impart an impact to a stuck portion of the tool string 200, such as the lower portion 118 of the tool string 200, to help free the stuck portion of the tool string 200. The energy for the impact may be stored in the conveyance line 120 for conveying the tool string 200 within the wellbore 102. That is, when a portion of the tool string 200 gets stuck (or jammed) within the wellbore 102, the conveyance line 120 may be pulled in an upward (uphole) direction by the conveyance device 140, 144 to build up tension and, thus, store energy in the stretched conveyance line 120 to be released by the impact tool 208. However, the energy for the impact may also or instead be stored as a pressure differential between portions of the impact tool 208, which may be utilized to actuate the impact tool 208 to impart the impact to the stuck portion of the tool string 200. Although the tool string 200 is shown comprising the impact tool 208, the impact tool 208 may not be included within the tool string 200. Thus, if the tool string 200 becomes stuck within the wellbore 102, other means of freeing the tool string 200 may be utilized.

The lower portion 118 of the tool string 200 may comprise one or more perforating tools (or guns) 210, such as may be operable to perforate or otherwise form holes though the casing 108, the cement 109, and the portion of the formation 106 surrounding the wellbore 102 to prepare the well for production. The perforating tools 210 may contain one or more shaped explosive charges 212 operable to perforate the casing 108, the cement 109, and the formation 106 upon detonation. The lower portion 118 of the tool string 200 may also comprise a plug 214 and a plug setting tool 216 for setting the plug 214 at a predetermined position within the wellbore 102, such as to isolate (or seal) a lower portion of the wellbore 102. The plug 214 may be permanent or retrievable, facilitating the lower portion of the wellbore 102 to be permanently or temporarily isolated, such as during treatment operations conducted on an upper portion of the wellbore 102.

Figure 3:
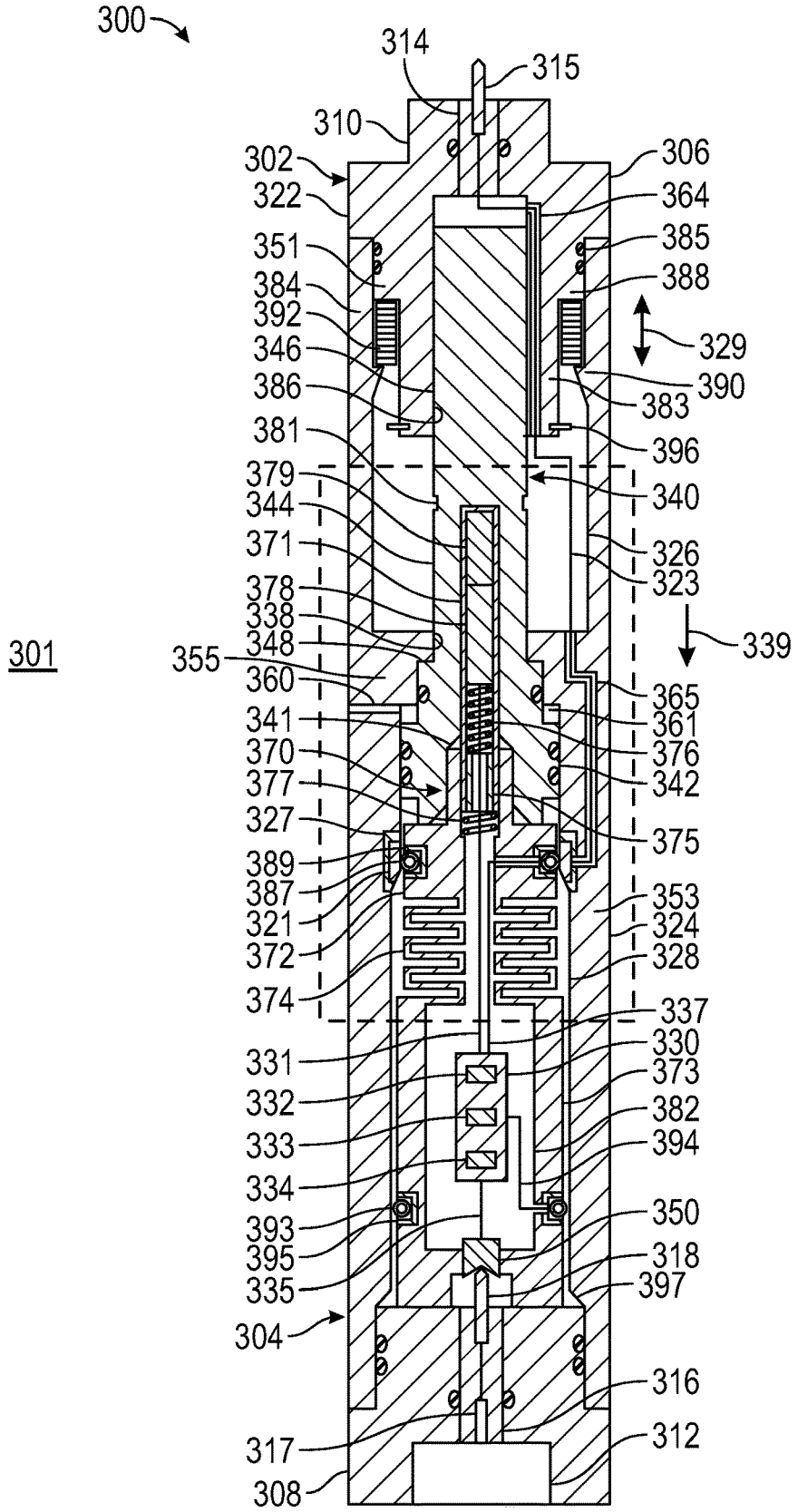
FIG. 3 is a schematic sectional view of at least a portion of an example implementation of apparatus according to one or more aspects of the present disclosure.
Figure 4:
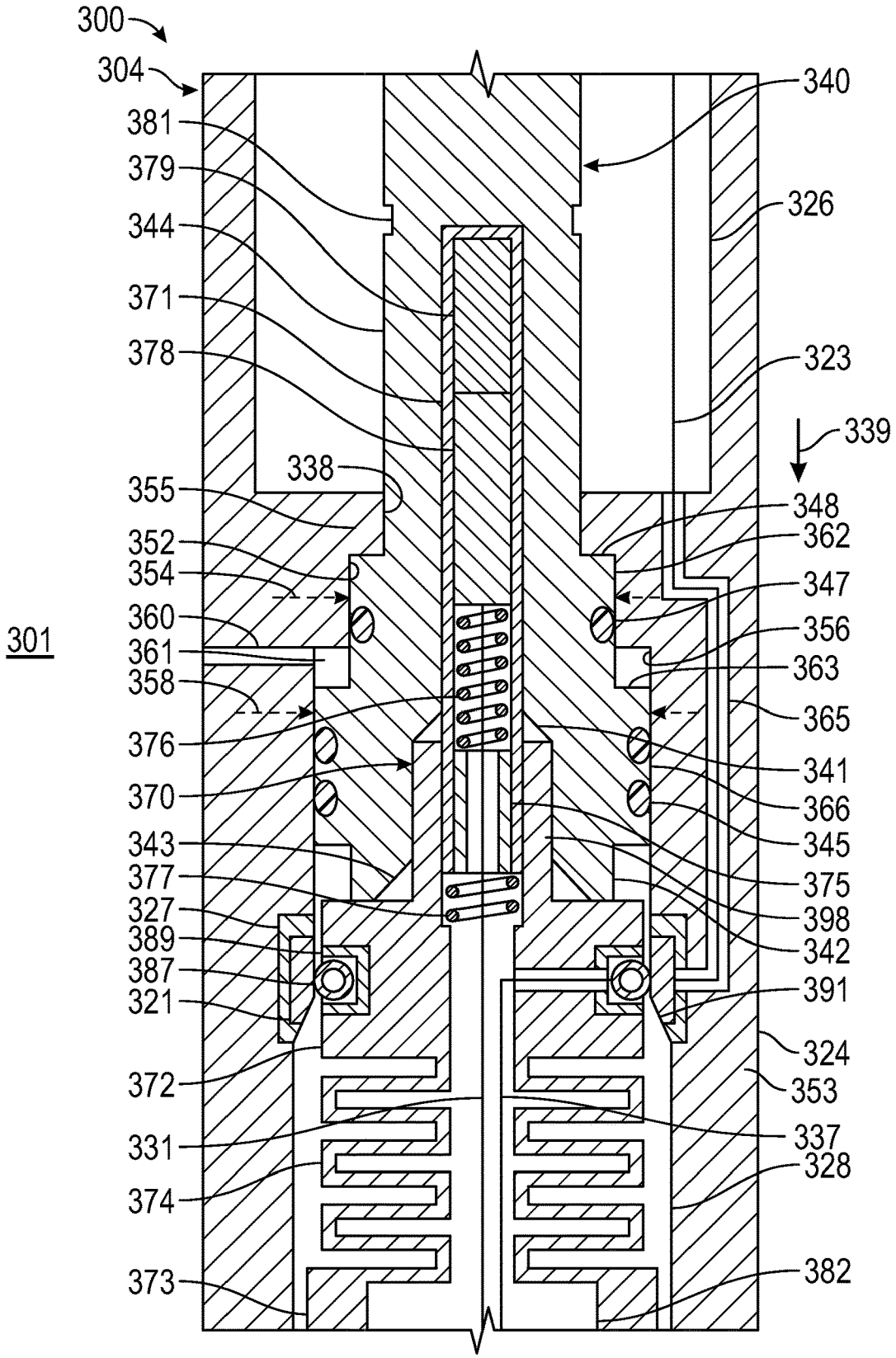
FIG. 4 is an enlarged view of a portion of the apparatus shown in FIG. 3.

FIG. 3 is a schematic sectional view of at least a portion of an example implementation of a release tool 300 according to one or more aspects of the present disclosure. FIG. 4 is an enlarged view of a portion of the release tool 300 shown in FIG. 3. The release tool 300 may be an example implementation of the release tool 114 described above and shown in FIGS. 1 and 2 and comprise one or more features and/or modes of operation of the release tool 114. Accordingly, the following description refers to FIGS. 1-4, collectively.

The release tool 300 may be connected (or coupled) between an upper portion 116 and a lower portion 118 of a tool string 110 to mechanically connect (or couple) the upper portion 116 and the lower portion 118 to each other to permit the tool string 110 to be conveyed within a wellbore 102. The release tool 300 may also be selectively operable to separate into two or more sections to release, uncouple, part, or otherwise disconnect the upper portion 116 and the lower portion 118 from each other while the tool string 110 is conveyed within the wellbore 102. For example, if the lower portion 118 is intended to be left in the wellbore 102, the release tool 300 may be operated downhole to separate and, thus, release the upper and lower portions 116, 118 from each other, which may then permit the upper portion 116 to be retrieved to a wellsite surface 104 by applying tension to a conveyance line 120 connected to the tool string 110 via one or more of conveyance devices 140, 144 at a wellsite surface 104. Also, if the lower portion 118 is stuck within the wellbore 102 (rendering it the "stuck portion"), the release tool 300 may be operated to separate and, thus, release the upper portion 116 (in this case, the "free portion") from the lower portion 118 of the tool string 110, such that the upper portion 116 of the tool string 110 can be retrieved to the wellsite surface 104.

The release tool 300 may include an upper (uphole) connector sub (or section) 302 operable to connect with the upper portion 116 of the tool string 110 and a lower (downhole) connector sub (or section) 304 operable to connect with the lower portion 118 of the tool string 110. The connector subs 302, 304 may collectively form or otherwise define one or more internal spaces, volumes, chambers, bores, and/or passages for accommodating or otherwise containing various components of the release tool 300. The connector subs 302, 304 may comprise corresponding connector heads 306, 308 (e.g., crossovers, end caps, etc.), which may include connectors, interfaces, and/or other means for mechanically and electrically coupling the release tool 300 with corresponding mechanical and electrical interfaces (not shown) of the upper and lower portions 116, 118 of the tool string 110. The upper connector head 306 may include a mechanical interface, a sub, and/or other means 310 for mechanically coupling the release tool 300 with a corresponding mechanical interface of the impact tool 208 or other tool of the upper portion 116 of the tool string 110. The lower connector head 308 may include a mechanical interface, a sub, and/or other means 312 for mechanically coupling with a corresponding mechanical interface of the lower portion 118 or other portion of the tool string 110 downhole from the release tool 300. Although the interface means 310, 312 are shown comprising pin and box couplings (e.g., ACME couplings), respectively, the interface means 310, 312 may alternatively comprise other pin and box couplings, threaded connectors, fasteners, and/or other mechanical coupling means.

The upper interface means 310 and/or other portion of the upper connector head 306 may further include an external upper electrical interface 314 comprising an electrical contact 315 or other means for electrically connecting the release tool 300 and/or electrical conductors extending through the release tool 300 with a corresponding external electrical interface of the impact tool 208 or other tool of the upper portion 116 of the tool string 110, whereby such corresponding electrical interface may be in electrical connection with the electrical conductor 117 of the upper portion 116 of the tool string 110. The lower interface means 312 and/or other portion of the lower connector head 308 may include an external lower electrical interface 316 comprising an external electrical contact 317 or other means for electrically connecting the release tool 300 and/or electrical conductors extending through the release tool 300 with a corresponding external electrical interface of the lower portion 118 of the tool string 110, whereby such corresponding electrical interface may be in electrical connection with the electrical conductor 119 of the lower portion 118. Although the external electrical contacts 315, 317 are shown comprising a pin and a receptacle, respectively, the electrical interfaces 314, 316 may alternatively each comprise other electrical connection means, including plugs, terminals, conduit boxes, and/or other electrical connectors. Each of the electrical interfaces 314, 316 may comprise fluid seals or otherwise be configured to form a fluid seal against the body of the corresponding connector heads 306, 308, such as to prevent or reduce the wellbore fluid or other external fluids from leaking into the internal spaces (or chambers) of the release tool 300 along or behind the electrical interfaces 314, 316 during downhole operations.

The upper connector sub 302 may comprise an upper housing 322 (or body) and the lower connector sub 304 may further comprise a lower housing (or body) 324. The upper housing 322 may be integrally formed with or otherwise fixedly connected to the upper connector head 306. The lower housing 324 may be fixedly (e.g., threadedly) connected to the lower connector head 308. The upper housing 322 may comprise an outer wall 351 and the lower housing 324 may comprise an outer wall 353 and an inner wall 355 extending radially inward from the outer wall 353. The connector heads 306, 308 and/or the housings 322, 324 may comprise inner surfaces collectively defining one or more internal spaces 326, 328 (e.g., bores or chambers) when the connector subs 302, 304 are connected. For example, the upper connector head 306, the upper housing 322, and the lower housing 324 may collectively define an upper internal space 326 and the lower connector head 308 and the lower housing 324 may collectively define a lower internal space 328. The inner wall 355 of the lower housing 324 may be located between the internal spaces 326, 328 and partially separate or otherwise define the internal spaces 326, 328. The internal spaces 326, 328 may be connected via an axial passage (or bore) 338 extending through the inner wall 355. The internal spaces 326, 328 are identified with different numerals for clarity and ease of understanding, however, because the passage 338 connects the internal spaces 326, 328, the internal spaces 326, 328 may be collectively considered as a single continuous internal space (or chamber).

The lower internal space 328 may include internal space portions having different inner diameters. For example, the lower internal space 328 may comprise a smaller diameter portion 352 located at an upper end of the lower internal space 328 and having an inner diameter 354. The lower internal space 328 may comprise a larger diameter portion 356 located below the smaller diameter portion 352 and having an inner diameter 358 that may be appreciably larger than the inner diameter 354 of the smaller diameter portion 352.

The release tool 300 may further comprise a support member (or a connecting member) 340 (e.g., a shaft, a bolt, a fastener, etc.) mechanically connecting (or coupling) together the upper connector sub 302 and the lower connector sub 304. The support member 340 may be disposed within the internal spaces 326, 328 and extend through the passage 338 between the internal spaces 326, 328. The support member 340 may be connected to both the upper housing 322 of the upper connector sub 302 and the lower housing 324 of the lower connector sub 304 to thereby connect together the upper connector sub 302 and the lower connector sub 304. The support member 340 may comprise a head 342 connected to the lower housing 324 and a shank 344 connected to the upper housing 322. The shank 344 may be connected with and extend from the head 342. The support member 340 may comprise an inner surface forming or otherwise defining an internal space 341 (e.g., a bore or chamber) extending axially through a portion of the support member 340. The internal space 341 may comprise an opening 343 at a lower end of the head 342 and extend upward through the head 342 and partially through the shank 344. The internal space 341 may be open to or otherwise connected with the lower internal space 328. The internal spaces 328, 341 are identified with different numerals for clarity and ease of understanding, however, because the internal spaces 328, 341 are connected, the internal spaces 328, 341 may be collectively considered as a single continuous internal space (or chamber).

The head 342 may be configured to latch against a portion of the lower housing 324 of the lower connector sub 304. For example, the head 342 may comprise an upward-facing (or radially outward-extending) shoulder 348 configured to be disposed against (or abut) a downward-facing (or radially inward-extending) shoulder (or surface) of the inner wall 355 surrounding the passage 338, such as to prevent the head 342 of the support member 340 from moving upward with respect to the lower connector sub 304. The shank 344 may extend through the passage 338 into the internal space 326 and connect with the upper housing 322 of the upper connector sub 302 to maintain connection between the connector subs 302, 304. An upper portion of the shank 344 may comprise a connection portion 346 and a lower portion 383 of the upper housing 322 may comprise a connection portion 386. The connection portion 346 may be fixedly connected (or coupled) with the connection portion 386. The connection portion 346 may be or comprise external (or male) threads and the connection portion 386 may be or comprise internal (or female) threads. The external threads of the connection portion 346 may be configured to threadedly engage the internal threads of the connection portion 386 to fixedly, but detachably, connect the shank 344 of the support member 340 to the upper housing 322 of the upper connector sub 302, such as to prevent the shank 344 from moving with respect to the upper connector sub 302.

The head 342 may be or operate as a piston slidably (or telescopically) disposed within the lower internal space 328 and sealingly engaging the inner surface of the lower housing 324 defining the internal space 328. The head 342 may include different portions having different outer diameters, with each different portion configured to be slidably disposed within a corresponding portion of the internal space 328. For example, the head 342 may comprise an upper head portion 362 slidably disposed within the smaller diameter portion 352 and a lower head portion 366 slidably disposed within the larger diameter portion 356. Thus, the upper head portion 362 may have an outer diameter substantially (almost or mostly) equal to (or slightly smaller than) the inner diameter 354 of the smaller diameter portion 352 of the internal space 328, and the lower head portion 366 may have an outer diameter substantially equal to (or slightly smaller than) the inner diameter 358 of the larger diameter portion 356 of the internal space 328. The head 342 may further comprise an upward-directed (and radially outward-extending) piston face 363 (i.e., transition surface or shoulder) extending radially between the upper head portion 362 and the lower head portion 366.

One or more fluid ports 360 (e.g., bores, holes, openings, etc.) may extend through the outer wall 353 of the lower housing 324 and fluidly connect the space 301 external to the release tool 300 (hereinafter "external space") with the upper end of the lower internal space 328. The head 342 of the support member 340 may be positioned within the upper end of the lower internal space 328 adjacent the port 360 and prevent or inhibit wellbore fluid from flowing into the internal spaces 326, 328 of the release tool 300 via the port 360. The head 342 may therefore maintain the internal spaces 326, 328 of the release tool 300 at a pressure that is substantially higher than ambient pressure of the external space 301 when the release tool 300 is conveyed within the wellbore 102. For example, the lower head portion 366 may carry one or more fluid seals 345 configured to fluidly seal against the inner surface of the lower housing 324 defining the larger diameter portion 356 to prevent or reduce fluids from leaking into the rest of the lower internal space 328 located below the head 342. The upper head portion 362 may carry one or more fluid seals 347 configured to fluidly seal against the inner surface of the lower housing 324 defining the smaller diameter portion 352 to prevent or reduce fluids from leaking into the upper internal space 326 located above (uphole from) the head 342 via the passage 338. Accordingly, each fluid seal 345, 347 may be configured to fluidly seal against the inner surface of the lower housing 324 of the lower connector sub 304 to fluidly isolate the internal spaces 326, 328 of the release tool 300 from the external space 301.

The fluid seals 345, 347 may be located on opposing sides of the piston face 363. The head 342 of the support member 340 may be positioned within the upper end of the lower internal space 328 such that portions of the upper head portion 362, the lower head portion 366, and the piston face 363 are open to, in fluid communication with, or otherwise exposed to the external space 301 via the port 360. Thus, a portion of the upper end of the lower internal space 328 defined by the lower housing 324 adjacent the port 360, portions of the upper head portion 362 and the lower head portion 366 between the fluid seals 345, 347, and the piston face 363 may collectively define a portion 361 of the lower internal space 328 (hereinafter "exposed internal space") that is open to, in fluid communication with, or otherwise exposed to the external space 301 via the port 360 and, thus, exposed to the pressure within the external space 301. Furthermore, when the release tool 300 is conveyed downhole within the wellbore 102 as part of the tool string 110, the port 360 may permit wellbore fluid located within the wellbore 102 to flow into or be in fluid communication with such exposed internal space 361 such that pressure within the exposed internal space 361 is substantially equal to the pressure of the external space 301, namely, the hydrostatic pressure within the wellbore 102 external to the release tool 300. Thus, the head 342 of the support member 340 can fluidly isolate or separate the exposed internal space 361 from the rest of the internal spaces 326, 328 to block the wellbore fluid and the hydrostatic pressure from entering the internal spaces 326, 328 while the tool string 110 is located within the wellbore 102.

When the release tool 300 is conveyed within the wellbore 102, a pressure differential may be formed across the lower head portion 366. That is, while the release tool 300 is conveyed downhole, pressure within the upper internal space 326 above the head 342 and the lower internal space 328 below the head 342 may be maintained substantially constant or otherwise appreciably lower than the pressure within the exposed internal space 361 between fluid seals 345, 347, which is maintained at the hydrostatic wellbore pressure of the external space 301. When the tool string 110 reaches the predetermined depth or position within the wellbore 102, the pressure within the exposed internal space 361 may be appreciably greater than the pressure within the fluidly isolated portion of the lower internal space 328. The hydrostatic pressure applied to the piston face 363 may impart a net downward force on the piston head 342, biasing the support member 340 in a downward (downhole) direction, as indicated by arrow 339.

The upper housing 322 of the upper connector sub 302 may be configured to slidably engage the lower housing 324 of the connector sub 304 while being maintained in such slidably engaged position by the support member 340 extending between and fixedly connecting the connector subs 302, 304. For example, the lower housing 324 of the connector sub 304 may comprise an upper portion 384 configured to slidably receive or otherwise accommodate therein the lower portion 383 of the upper housing 322 of the upper connector sub 302. One or more fluid seals 385 may be disposed between the lower and upper portions 383, 384 to prevent or inhibit wellbore fluid from leaking into the upper internal space 326.

The lower portion 383 of the upper housing 322 may comprise a downward-facing (or radially outward-extending) shoulder 388 and the upper portion 384 of the lower housing 324 may comprise an upward-facing (or radially inward-extending) shoulder 390. A biasing member 392 may be disposed between the shoulders 388, 390. The biasing member 392 may be compressed between the shoulders 388, 390 when the lower portion 383 of the connector sub 302 slides into or enters the upper portion 384 of the connector sub 304 to generate a biasing expansion force, indicated by arrows 329, which may urge separation of the connector subs 302, 304. The biasing member 392 may therefore be compressible and may be or comprise one or more coil springs and/or Belleville springs (or washers), among other examples. A retaining member 396 (e.g., a retaining ring or washer) may extend around or radially outward from a lower end of the lower portion 383 of the upper housing 322, such as to maintain the biasing member 392 about the lower portion 383 or otherwise in association with the connector sub 302 when the connector subs 302, 304 are separated.

The release tool 300 may further comprise an explosive assembly 370 disposed within one or more of the internal spaces 326, 328 and operable to sever the support member 340 to therefore disconnect the upper connector sub 302 and the lower connector sub 304 from each other and, thus, disconnect the upper portion 116 of the tool string 110 and the lower portion 118 of the tool string 110 from each other when the tool string 110 is conveyed downhole within the wellbore 102. The explosive assembly 370 may comprise an explosive charge 378, 379, which, when detonated, may sever, split, or otherwise separate the support member 340 radially to release or disconnect the connector sub 302 and the connector sub 304 from each other. The explosive assembly 370 may further comprise a detonator switch 332 operable to detonate (e.g., via an electrical charge) the explosive charge 378, 379. The explosive assembly 370 may also comprise a housing assembly 371, 372, 373, 374 containing the explosive charge 378, 379 and the detonator switch 332. The explosive assembly 370 may be or comprise an explosive cartridge movable as a single unit and installable (or disposable) within one or more of the internal spaces 326, 328, 341 within or defined by one or more of the upper connector sub 302, the support member 340, and the lower connector sub 304. The explosive assembly 370 may be movable into and installable within the internal spaces 328, 341 such that the explosive charge 378, 379 is disposed within the internal space 341 of the shank 344 of the support member 340 and/or the detonator switch 332 is disposed within the lower internal space 328. For example, the explosive assembly 370 may be slidably insertable into the internal spaces 328, 341 such that the explosive charge 378, 379 is disposed within the internal space 341 of the support member 340 and/or the detonator switch 332 is disposed within the lower internal space 328. The explosive assembly 370 may be connectable to the support member 340 such that the explosive charge 378, 379 is maintained within the internal space 341 of the support member 340 and/or the detonator switch 332 is maintained within the lower internal space 328. Accordingly, when the explosive charge 378, 379 is detonated by the detonator switch 332, the explosive charge 378, 379 may be operable to sever, split, or otherwise radially separate the shank 344 of the support member 340 to therefore disconnect the upper connector sub 302 and the lower connector sub 304 from each other.

The explosive charge 378, 379 may comprise a detonator or primary charge 378 and a secondary charge 379, such as HMX or RDX. The detonator switch 332 may be operable to cause detonation of the primary charge 378, which in turn may cause detonation of the secondary charge 379. The explosive charge 378, 379 may be located adjacent a cavity or notch 381 extending circumferentially around the shank 344, which may cause or help the explosive charge 378, 379 to radially sever or split the shank 344 along the circumferential notch 381. The detonator switch 332 may be electrically connected with the primary charge 378 via an electrical conductor 331 extending therebetween.

The housing assembly 371-374 may comprise an upper housing portion 371, 372 containing the explosive charge 378, 379 and a lower housing portion 373 containing the detonator switch 332. The upper housing portion 371, 372 may be configured for connection with the head 342 of the support member 340 such that the upper housing portion 371, 372 is prevented or inhibited from moving with respect to the head 342 to thereby maintain the explosive charge 378, 379 within the internal space 341 of the shank 344 of the support member 340 and/or maintain the lower housing portion 373 (and the detonator switch 332 contained therein) within the lower internal space 328 of the lower connector sub 304. The material forming one or more portions of the housing assembly 371-374 may be or comprise, for example, a soft metal (e.g., aluminum) or a thermoplastic material (e.g., nylon).

The upper housing portion 371, 372 may comprise an elongated container 371 (e.g., a cylindrical sleeve) holding or otherwise containing the explosive charge 378, 379. The elongated container 371 may be closed on the upper end. The explosive charge 378, 379 may be retained within the elongated container 371 by a retaining member 375 (e.g., a plug) disposed within or otherwise fixedly connected at the lower end of the elongated container 371. For example, the retaining member 375 may fixedly (e.g., threadedly) engage with the lower end of the elongated container 371, such as via complementary threads, complementary pins and grooves, dogs, or interference fit. The explosive charge 378, 379 may be maintained at the upper end of the elongated container 371 by a biasing member 376 (e.g., a spring) disposed between the retaining member 375 and the explosive charge 378, 379.

The upper housing portion 371, 372 may further comprise a connector (or adapter) 372 configured for connection with the head 342 of the support member 340. The connector 372 may also be connected to or configured for connection to the elongated container 371 and/or the lower housing portion 373. Accordingly, the connector 372 may be configured for connecting the housing assembly 371-374 to the head 342 such that the explosive charge 378, 379 contained within the elongated container 371 is maintained disposed within the internal space 341 of the support member 340 and/or the detonator switch 332 contained within the lower housing portion 373 is maintained disposed within the internal space 328 of the lower housing 324. For example, the upper end 398 of the connector 372 may comprise external threads configured to engage internal threads of the head 342 to fixedly (e.g., threadedly) connect the connector 372 with the head 342. The upper end 398 of the connector 372 may instead be configured to engage and fixedly connect with the head 342 via other means, such as complementary pins and grooves, splines, and/or dogs. The upper end 398 of the connector 372 may instead be configured to engage and fixedly connect with the head 342 via still other means, such as interference fit (i.e., friction) between an outer surface of the upper end 398 of the connector 372 and an inner surface of the head 342. A flexible member (not shown), such as an O-ring, may be disposed between the outer surface of the upper end 398 of the connector 372 and an inner surface of the head 342 to facilitate friction between the upper end 398 of the connector 372 and the head 342. The flexible member may be carried by the upper end 398 of the connector 372 and/or the head 342. Such friction may be low enough to permit manual insertion of the explosive assembly 370 into the internal spaces 328, 341, but still high enough (i.e., sufficient) to maintain connection between the connector 372 and the head 342. The connector 372 may instead be configured for movable connection with the head 342 of the support member 340, whereby the upper end 398 of the connector 372 is configured to movably (e.g., slidably, telescopically, etc.) engage with the head 342. For example, the upper end 398 of the connector 372 may be configured to be slidably inserted into a lower end of the internal space 341. In such implementation, the housing assembly 371-374 (and the entire explosive assembly 370) may be maintained within the internal spaces 328, 341 of the release tool 300 (such that the explosive charge 378, 379 is maintained disposed within the internal space 341 and/or the detonator switch 332 is maintained disposed within the internal space 328) via contact between the lower housing portion 373 and the lower connector head 308, thereby preventing the explosive assembly 370 from moving within the internal spaces 328, 341.

The connector 372 may have an inner surface forming or otherwise defining an internal space (or passage) configured to accommodate the electrical conductor 331 connecting the explosive charge 378, 379 and the detonator switch 332. The upper end 398 of the connector 372 may fixedly (e.g., threadedly) engage with the lower end of the elongated container 371, such as via complementary threads, complementary pins and grooves, dogs, or interference fit. The connector 372 may instead be movably (e.g., flexibly, slidably, telescopically, etc.) connected to the elongated container 371, such as to permit limited axial movement between the elongated container 371 and the connector 372. For example, the upper end 398 of the connector 372 may slidably engage with the lower end of the elongated container 371. A biasing member 377 (e.g., a spring) may also be disposed between the elongated container 371 and a shoulder of the connector 372. Thus, when the upper housing portion 371, 372 is inserted into the internal space 341 and the elongated container 371 contacts the upper end of the internal space 341, the biasing member 377 may be compressed, thereby permitting the connector 372 to move further upward to connect with (or fully engage) the head 342. Furthermore, when the connector 372 is connected with the head 342 of the support member 340, the elongated container 371 and the explosive charge 378, 379 disposed within the elongated container 371 may be maintained at the upper end of the internal space 341 by the biasing member 377.

The lower housing portion 373 may be or comprise a container having an inner surface forming or otherwise defining an internal space (or chamber) 382. The internal space 382 may contain the detonator switch 332. The connector 372 of the upper housing portion 371, 372 may be fixedly connected to the lower housing portion 373, such that relative movement between the upper housing portion 371, 372 and the lower housing portion 373 is prevented or inhibited. The connector 372 of the upper housing portion 371, 372 may instead be movably (e.g., flexibly, slidably, telescopically, etc.) connected to the lower housing portion 373, such as to permit limited axial movement between the upper housing portion 371, 372 and the lower housing portion 373. For example, the lower end of the connector 372 may slidably engage with the upper end of the lower housing portion 373. The lower end of the connector 372 and the upper end of the lower housing portion 373 may instead be flexibly connected such that the upper housing portion 371, 372 and the lower housing portion 373 can move a limited axial distance with respect to each other. For example, the housing assembly 371-374 may further comprise a flexible (or compressible) intermediate housing portion 374 (e.g., a flexible connector, a bellows, interlocked sheath or conduit, etc.) flexibly connecting the upper housing portion 371, 372 and the lower housing portion 373 such that the upper housing portion 371, 372 and the lower housing portion 373 can move a limited axial distance with respect to each other. The intermediate housing portion 374 may have an inner surface forming or otherwise defining an internal space (or passage) configured to accommodate the electrical conductor 331 connecting the explosive charge 378, 379 and the detonator switch 332.

The internal space 382 may further contain an electronics package 330, such as an electronics circuit board. The electronics package 330 may comprise various electronic components facilitating reception, recording, processing, output, and/or transmission of sensor data and control data. The electronics package 330 may comprise a downhole controller 333 (e.g., a processing device) and a communication device 334. The electronics package 330 may also comprise the detonator switch 332.

The detonator switch 332 may be or comprise an addressable detonator switch, such as may be operated from the wellsite surface 104 by the power and control system 150 via various electrical conductors (e.g., conductors 115, 117, 119, 122) extending between the power and control system 150 and the detonator switch 332. If additional explosive charges are included within the tool string 110, such as within each perforating tool 210, multiple addressable switches may permit each perforating tool 210 to be triggered sequentially or otherwise independently from the detonator switch 332. The detonator switch 332 may also be or comprise a timer, such as may detonate the explosive charge 378, 379 at a predetermined time. The detonator switch 332 may be battery powered to permit the detonator switch 332 to be operated (or triggered) without the electrical conductors extending to the wellsite surface 104. Although the detonator switch 332 is shown and described herein as being configured for wired communication, the detonator switch 332 may instead be configured for wireless communication with a corresponding wireless device located at the wellsite surface 104 or other portion of the tool string 110. Such wireless detonator switch may permit the detonator switch 332 to be operated from the wellsite surface 104 without utilizing the electrical conductors extending to the wellsite surface 104.

The release tool 300 may further comprise a plurality of interconnected electrical conductors, connectors, and/or interfaces collectively forming an electrical path extending through the release tool 300. Accordingly, various portions of the release tool 300, including the housings 322, 324 of the connector subs, 302, 304 and the internal spaces 326, 328 may comprise, form, or define one or more internal passages (or bores) for accommodating or otherwise containing the various electrical conductors, connectors, and/or interfaces collectively forming the electrical path.

The electrical path may extend between the upper electrical interface 314 and the electronics package 330, such as to facilitate communication between the power and control system 150 and the electronics package 330 and/or facilitate delivery of electrical power from the power and control system 150 to the electronics package 330 when the release tool 300 is conveyed downhole within the wellbore 102 as part of the tool string 110. The electrical path may also extend through the release tool 300 between the upper electrical interface 314 and the lower electrical interface 316, such as to also facilitate communication between the power and control system 150 and the lower portion 118 of the downhole tool string 110 and/or facilitate delivery of electrical power from the power and control system 150 to the lower portion 118 of the downhole tool string 110 when the release tool 300 is conveyed downhole within the wellbore 102 as part of the tool string 110 containing the lower portion 118. The electrical path may therefore extend through the release tool 300 between the upper electrical interface 314 and the lower electrical interface 316 to electrically connect the upper portion 116 of the downhole tool string 110 and the lower portion 118 of the downhole tool string 110 with each other when the release tool 300 connects the upper portion 116 of the downhole tool string 110 and the lower portion of the downhole tool string 110 with each other.

The explosive assembly 370 may comprise a portion of the electrical path, such as to facilitate communication between the power and control system 150 and the electronics package 330 (including the detonator switch 332), facilitate delivery of electrical power from the power and control system 150 to the electronics package 330 (including the detonator switch 332), facilitate communication between the power and control system 150 and the lower portion 118 of the downhole tool string 110, and/or facilitate delivery of electrical power from the power and control system 150 to the lower portion 118 of the downhole tool string 110. For example, the explosive assembly 370 may comprise one or more external electrical interfaces (e.g., electrical contacts or terminals) comprising means for electrically connecting the explosive assembly 370 (including the detonator switch 332) with one or more of the electrical interfaces 314, 316, and, thus, electrically connect the explosive assembly 370 with one or more of the electrical conductors 117, 119 of the tool string 110.

As described above, the electrical path may extend between the upper electrical interface 314 and the electronics package 330. Thus, the electrical path of the release tool 300 may comprise the upper electrical interface 314. The release tool 300 may further comprise an internal upper electrical interface 321 electrically connected with the electrical interface 314 via an electrical conductor 323 extending therebetween. The electrical conductor 323 may pass through a passage (or bore) 364 extending through the upper housing 322 of the upper connector sub 302, through the upper internal space 326, and through a passage (or bore) 365 extending through the lower housing 324 of the lower connector sub 304. The electrical interface 321 may extend circumferentially along the inner surface of the lower housing 324 defining the lower internal space 328. The electrical interface 321 may be electrically insulated from the lower housing 324 by an electrical insulator 327 (e.g., peek, thermoplastic material, ceramic material, etc.) extending circumferentially around the electrical interface 321 between the electrical interface 321 and the lower housing 324. The explosive assembly 370 may further comprise an electrical interface 387 electrically connected with the electronics package 330 via an electrical conductor 337 extending therebetween. The electrical conductor 337 may pass through a passage (or bore) extending through the wall of the housing assembly 371-374 and the internal space 382 of the housing assembly 371-374. The electrical interface 387 may be configured to electrically connect with the electrical interface 321 when the explosive assembly 370 is installed within the internal spaces 328, 341 to therefore electrically connect the explosive assembly 370 with the electrical conductor 117 of the upper portion 116 of the tool string 110 connected with the release tool 300. The electrical interface 387 may extend circumferentially along an outer surface of the housing assembly 371-374 disposed within the internal space 328. For example, the electrical interface 387 may extend circumferentially along an outer surface of the connector 372, the intermediate housing portion 374, or the lower housing portion 373. The electrical interface 387 may be electrically insulated from the housing assembly 371-374 by an electrical insulator 389 extending circumferentially around the electrical interface 387 between the electrical interface 387 and the housing assembly 371-374. The electrical interface 387 may be disposed within a circumferential channel extending circumferentially along the outer surface of the housing assembly 371-374 disposed within the internal space 328. Accordingly, the electrical path of the release tool 300 may comprise the electrical interfaces 314, 321, 387 and the electrical conductors 323, 331, 337.

The electrical interfaces 321, 387 may be or comprise electrical contacts 321, 387 configured to contact and, thus, electrically connect with each other. The electrical contact 387 may be or comprise an annular member (e.g., ring, sleeve, etc.) extending circumferentially along the outer surface of the housing assembly 371-374 disposed within the internal space 328. The electrical contact 387 may be or comprise a flexible member extending radially outward from the outer surface of the housing assembly 371-374 and into contact with the electrical contact 321 when the explosive assembly 370 is installed within the internal spaces 328, 341. The electrical contact 387 may be or comprise a canted coil spring (or garter spring) or other flexible ring-shaped member. The electrical contact 321 may be or comprise an annular member (e.g., ring, sleeve, etc.) extending circumferentially along an inner surface of the lower housing 324 defining the internal space 328. The electrical contact 321 may be flush with the inner surface defining the internal space 328 or the electrical contact 321 may extend radially inward from the inner surface and into contact with the electrical contact 387 when the explosive assembly 370 is installed within the internal spaces 328, 341. At least a portion of the electrical contact 321 may be tapered 391 inward in the upward direction such as to facilitate compression of the electrical contact 387 against the electrical contact 321 to facilitate a more robust (or sturdier) electrical connection between the electrical contacts 321, 387 as the explosive assembly 370 is installed within the internal spaces 328, 341.

As also described above, the electrical path may extend between the lower electrical interface 316 and the electronics package 330. Thus, the electrical path of the release tool 300 may comprise the lower electrical interface 316. The lower electrical interface 316 may further comprise an internal electrical contact 318 configured to electrically connect with a corresponding electrical interface 350 of the explosive assembly 370 when the explosive assembly 370 is installed within the internal spaces 328, 341 to therefore electrically connect the explosive assembly 370 with the electrical conductor 119 of the lower portion 118 of the tool string 110 connected with the release tool 300. The electrical interface 350 may extend through a lower wall of the lower housing portion 373 between the internal space 382 and the internal space 328. The electrical interface 350 may be electrically connected with the electronics package 330 via an electrical conductor 335 extending therebetween. Accordingly, the electrical path of the release tool 300 may further comprise the electrical interfaces 316, 350 and the electrical conductor 335. The electrical interface 350 may be or comprise an electrical contact 350 configured to contact and, thus, electrically connect with the electrical contact 318. Although the electrical contact 318 is shown implemented as a pin and the electrical contact 350 is shown implemented as a receptacle, in other implementations of the release tool 300 and/or the explosive assembly 370, the electrical contact 318 may be implemented as a receptacle or other electrical contact and the electrical contact 350 may be implemented as a pin or other electrical contact.

The explosive assembly 370 may further comprise an electrical interface 393 electrically connected with the electronics package 330 via an electrical conductor 394 extending therebetween. The electrical conductor 394 may pass through a passage (or bore) extending through the wall of the housing assembly 371-374 and the internal space 382 of the housing assembly 371-374. The electrical interface 393 may be configured to electrically connect with the inner surface of the lower housing 324 defining the internal space 328 to thereby establish an electrical ground connection between the electronics package 330 and the lower housing 324 of the lower connector sub 304. The electrical interface 393 may extend circumferentially along an outer surface of the housing assembly 371-374 disposed within the internal space 328. For example, the electrical interface 393 may extend circumferentially along an outer surface of the connector 372, the intermediate housing portion 374, or the lower housing portion 373. The electrical interface 393 may be electrically insulated from the housing assembly 371-374 by an electrical insulator 395 extending circumferentially around the electrical interface 393 between the electrical interface 393 and the housing assembly 371-374. The electrical interface 393 may be disposed within a circumferential channel extending circumferentially along the outer surface of the housing assembly 371-374 disposed within the internal space 328.

The electrical interface 393 may be or comprise an electrical contact 393 configured to contact and, thus, electrically connect with the lower housing 324 of the lower connector sub 304. The electrical contact 393 may be or comprise an annular member (e.g., a ring, a sleeve, etc.) extending circumferentially along the outer surface of the housing assembly 371-374 disposed within the internal space 328. The electrical contact 393 may be or comprise a flexible member extending radially outward from the outer surface of the housing assembly 371-374 and into contact with the lower housing 324 of the lower connector sub 304 when the explosive assembly 370 is installed within the internal spaces 328, 341. The electrical contact 393 may be or comprise a canted coil spring (or garter spring) or other flexible ring-shaped member. At least a portion of the inner surface of the lower housing 324 of the lower connector sub 304 may be radially tapered 397 inward in the upward direction such as to facilitate compression of the electrical contact 393 against the inner surface of the lower housing 324 to facilitate a more robust (or sturdier) electrical connection between the electrical contact 393 and the inner surface of the lower housing 324 as the explosive assembly 370 is installed within the internal spaces 328, 341.

The present disclosure is further directed to example methods (e.g., operations and/or processes) that can be performed to assemble or otherwise construct a release tool according to one or more aspects of the present disclosure. The methods may be performed by utilizing (or otherwise in conjunction with) at least a portion of one or more implementations of one or more instances of the release tool 300 shown in one or more of FIGS. 1-5, and/or otherwise within the scope of the present disclosure. However, the methods may also be performed in conjunction with implementations of release tool other than those depicted in FIGS. 1-5 that are also within the scope of the present disclosure.

Figure 5:
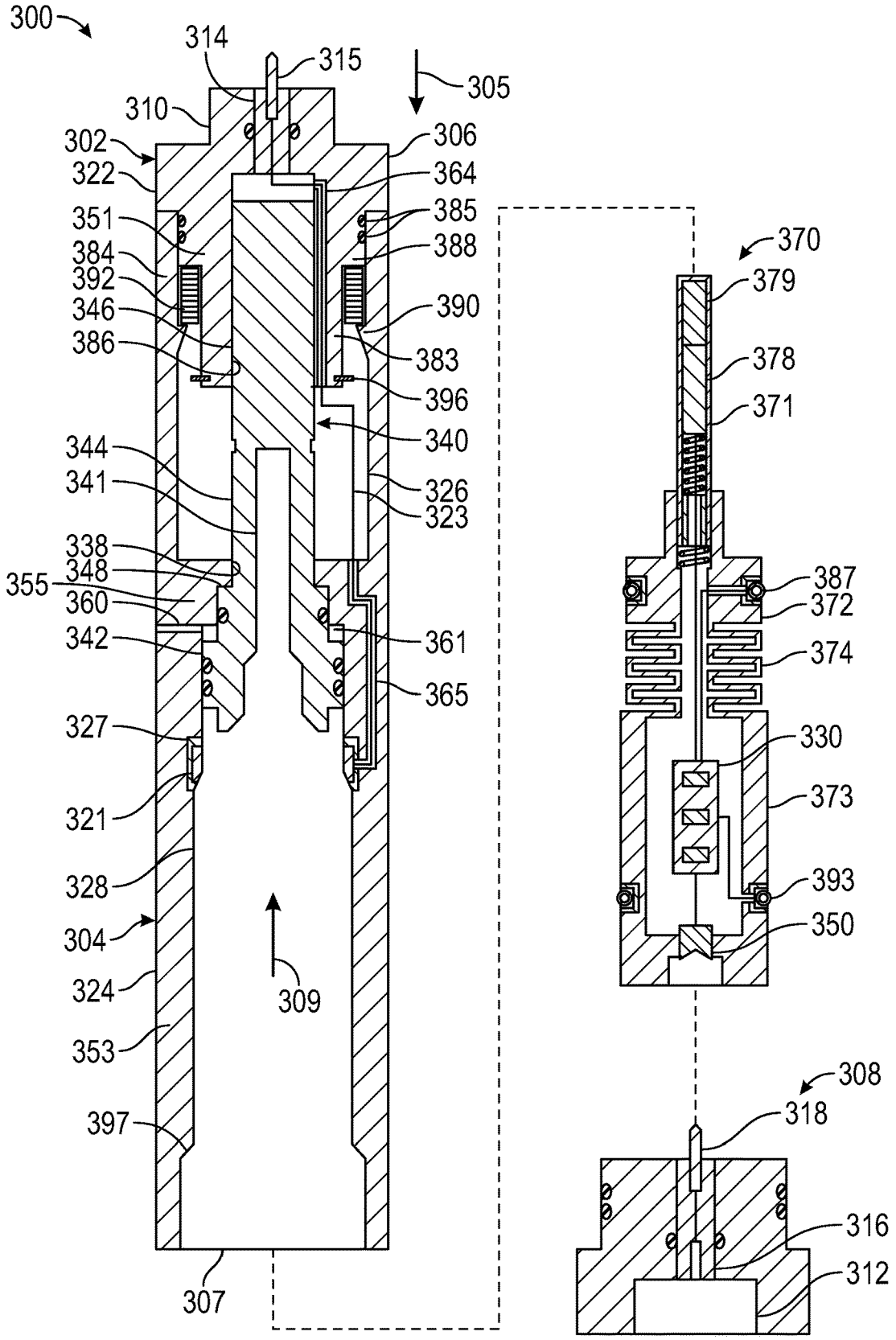
FIG. 5 is an exploded view of the apparatus shown in FIG. 3.

FIG. 5 shows the release tool 300 during assembly operations according to one or more aspects of the present disclosure. During assembly operations, the lower portion 383 of the upper housing 322 of the upper connector sub 302 may be at least partially inserted into the upper internal space 326 of the lower housing 324 of the lower connector sub 304, as indicated by arrow 305. The support member 340 may then be inserted into the lower internal space 328 of the lower connector sub 304 via an axial opening 307 to the upper internal space 326, as indicated by arrow 309. The shank 344 of the support member 340 may be inserted into and through the smaller diameter portion 352 of the lower internal space 328, the passage 338, and the upper internal space 326 and moved though the lower internal space 328 and the passage 338 until the connection portion 346 of the shank 344 contacts the connection portion 386 of the upper housing 322. One of the connector sub 302 and the support member 340 may then be rotated until the connection portion 346 threadedly engages the connection portion 386. As the connection portions 346, 386 progressively threadedly engage, the lower portion 383 of the upper housing 322 may fully enter and sealingly engage the upper portion 384 of the lower housing 324, the biasing member 392 may become compressed between the shoulders 388, 390, the head 342 of the support member 340 may become positioned at within the smaller diameter portion 352 and the larger diameter portion 356 of the lower internal space 328 such that the shoulder 348 of the head 342 engages the internal wall 355 of the lower housing 324 and the fluid seals 345, 347 engage corresponding inner surfaces of the lower housing 324 defining the smaller diameter portion 352 and the larger diameter portion 356 of the lower internal space 328. A predetermined torque may be applied to the connector sub 302 or the support member 340, such as to maintain the support member 340 at a predetermined tension.

Thereafter, the explosive assembly 370 may be slidably or otherwise inserted within the internal spaces 328, 341, as indicated by the arrow 309, such that the explosive charge 378, 379 is disposed within the internal space 341 of the support member 340. The explosive assembly 370 may then be rotated to threadedly connect the connector 372 of the housing assembly 371-374 to the head 342 of the support member 340 to thereby maintain the explosive assembly 370 within the internal spaces 328, 341. Inserting the explosive assembly 370 within the internal spaces 328, 341 may cause the upper electrical contact 387 to contact and, thus, establish electrical connection with the corresponding upper electrical contact 321 to thereby establish electrical connection between the upper electrical interface 314 and the detonator switch 332. Inserting the explosive assembly 370 within the internal spaces 328, 341 may cause the lower electrical contact 393 to contact and, thus, establish electrical ground connection with the lower housing 324. Installing the explosive assembly 370 within the internal spaces 328, 341 may further comprise enclosing the explosive assembly 370 within the internal spaces 328, 341 by the lower connector head 308. Enclosing the explosive assembly 370 may comprise rotating the connector head 308 with respect to the lower housing 324 to threadedly connect the connector head 308 to the lower housing 324. Enclosing the explosive assembly 370 may cause the electrical contact 318 to contact and, thus, establish electrical connection with the corresponding lower electrical contact 350 to thereby establish electrical connection between the upper electrical interface 314 and the lower electrical interface 316.

The present disclosure is further directed to example methods (e.g., operations and/or processes) that can be performed to operate or otherwise use a release tool according to one or more aspects of the present disclosure. The methods may be performed by using (or otherwise in conjunction with) at least a portion of one or more implementations of one or more instances of the release tool 300 shown in one or more of FIGS. 1-5, and/or otherwise within the scope of the present disclosure. However, the methods may also be performed in conjunction with implementations of release tool other than those depicted in FIGS. 1-5 that are also within the scope of the present disclosure.

An example method may include connecting the release tool 300 between the upper portion 116 of the downhole tool string 110 and the lower portion 118 of the downhole tool string 110, and then conveying the tool string 110 within the wellbore 102 via one or more of the conveyance devices 140, 144. FIGS. 3 and 4 show the release tool 300 in an inactivated position, representing a first release tool position (or a first position), in which the release tool 300 is utilized to transmit tension and/or compression generated by the conveyance devices 140, 144 at the wellsite surface 104 to a portion of the tool string 110 located below the release tool 300, such as during conveyance of the tool string 110. In the first position, the release tool 300 may be further operable to transmit tension and/or compression generated by the impact tool 208 incorporated into the tool string 110. In an example implementation, the release tool 300 may be operable to withstand a tension of about 100,000 pounds or more. Accordingly, one or more release tools 300 may be coupled along the tool string 110 above and/or below the impact tool 208. Coupling the release tool 300 below the impact tool 208 can permit the impact tool 208 to be recovered to the wellsite surface 104 if the impact tool 208 fails to free a stuck portion of the tool string 110.

As the tool string 110 is conveyed downhole along the wellbore 102, the hydrostatic pressure in the wellbore 102 external to the release tool 300 increases. However, the pressure within the internal spaces 326, 328, 341 may remain substantially constant (allowing for component material compressibility) because the internal spaces 326, 328, 341 are fluidly isolated by the head 342 of the support member 340 from the exposed internal space 361, which is exposed to the hydrostatic wellbore pressure via the port 360. Accordingly, when the tool string 110 reaches a predetermined depth or position within the wellbore 102, the pressure within the exposed internal space 361 may be appreciably greater than the pressure within the internal spaces 326, 328, 341, resulting in a net pressure differential across at least a portion of the head 342 that can impart a net downward (downhole) force to the head 342.

Figure 6:
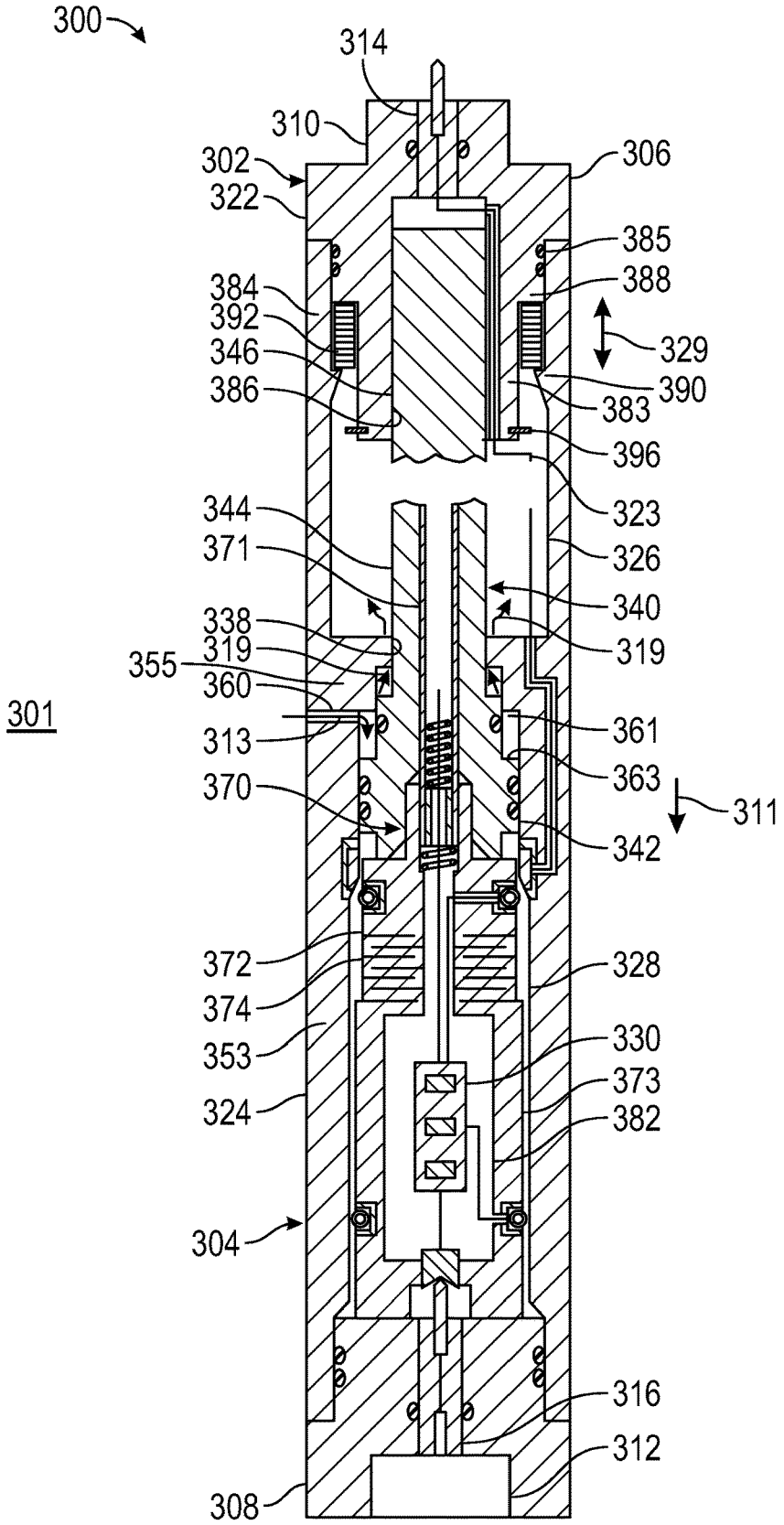
FIG. 6 is a schematic sectional view of the apparatus shown in FIG. 3 at a different stage of operation according to one or more aspects of the present disclosure.
Figure 7:
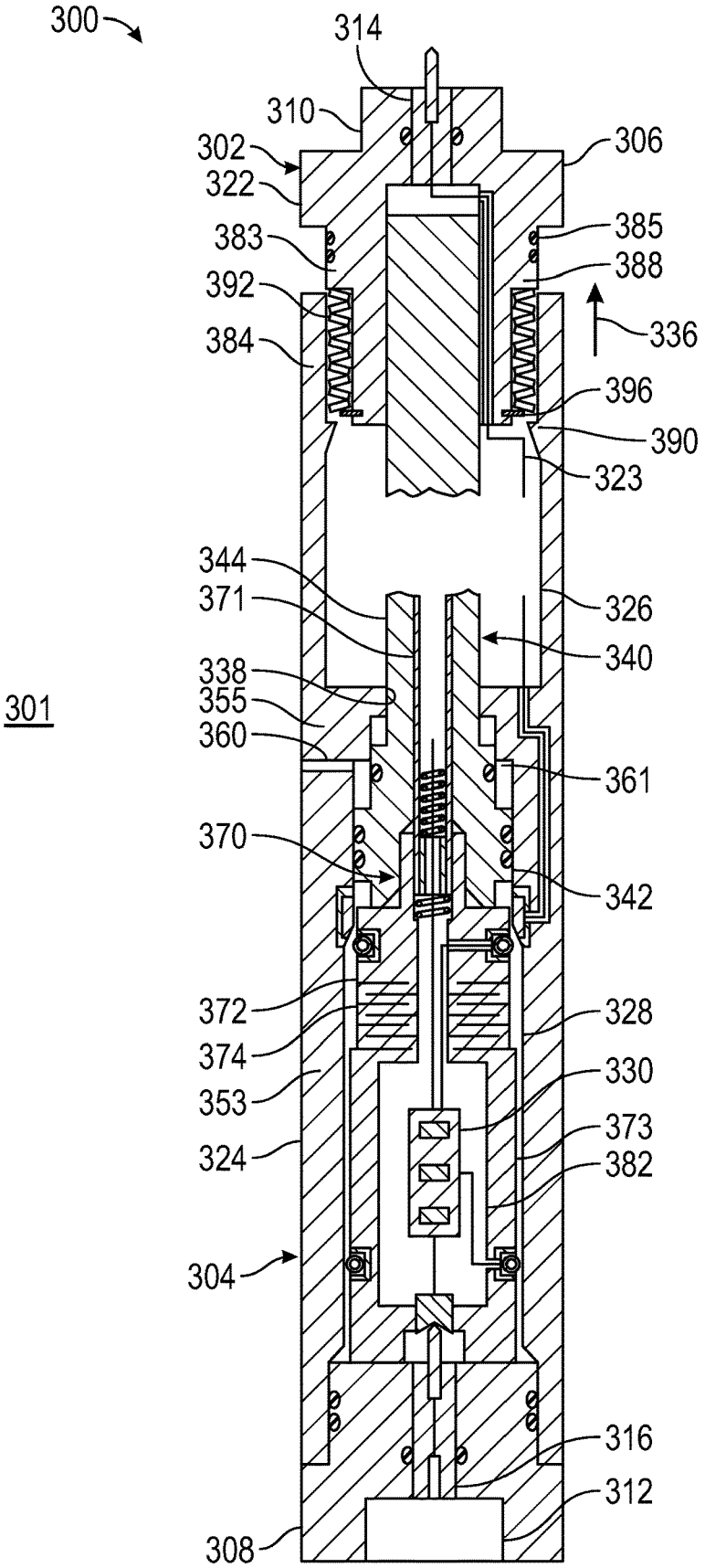
FIG. 7 is a schematic sectional view of the apparatus shown in FIGS. 3 and 6 at a different stage of operation according to one or more aspects of the present disclosure.

The method may further include operating the power and control system 150 to transmit control data (or a control signal) to the detonator switch 332 via the electrical conductors 122, 117, 115 to detonate the explosive charge 378, 379 to sever the support member 340 to therefore separate the release tool 300 (i.e., the upper connector sub 302 and the lower connector sub 304) and, thus, disconnect the upper portion 116 of the downhole tool string 110 coupled above the release tool 300 and the lower portion 118 of the downhole tool string 110 coupled below the release tool 300 from each other. Thus, when it is intended to release the upper portion 116 of the tool string 110 from the lower portion 118 of the tool string 110, the release tool 300 may be operated to disconnect the upper connector sub 302 from the lower connector sub 304, causing the release tool 300 to progress though a sequence of operational stages or positions during such release operations. FIGS. 6 and 7 are sectional views of the release tool 300 shown in FIGS. 3 and 4 in subsequent stages of release operations according to one or more aspects of the present disclosure. The following description refers to FIGS. 1-4, 6, and 7, collectively.

FIG. 6 shows the release tool 300 in a second release tool position (or a second position), shortly after the explosive charge 378, 379 has been detonated to sever, split, or otherwise separate the shank 344 of the support member 340 and, thus, disconnect (or unlatch) the connector sub 304 and the connector sub 302 from each other. After the shank 344 separates, the head 342 is no longer connected to the upper housing 322 and restrained against the shoulder of the internal wall 355, permitting the downward force imparted on the piston face 363 of the head 342 by the wellbore pressure within the exposed internal space 361 to move (or force) the head 342 in the downward direction along the lower internal space 328, as indicated by arrow 311. As the head 342 is moved downward 311, the head 342 may push the housing assembly 371-374, which is connected to the head 342, downward along the internal space 328. If or when the lower housing portion 373 contacts the lower connector head 308 or other lower end of the internal space 328, the head 342 may compress the housing assembly 371-374 within the internal space 328, causing the intermediate housing portion 374 to become compressed (or yield). The intermediate housing portion 374 may therefore permit the connector 372 and the head 342 connected with the connector 372 to move downward 311 when the head 342 is forced downward 311 by the wellbore pressure within the exposed internal space 361 after the shank 344 is separated by the explosive charge 378, 379. As the head 342 is moved downward 311, wellbore fluid may flow into the exposed internal space 361 via the port 360, as indicated by arrow 313. After the fluid seal 347 of the head 342 (or the entire upper head portion 362) moves out of the smaller diameter portion 352 of the internal space 328 (or disengages the inner surface of the lower housing 324 defining the smaller diameter portion 352), the wellbore fluid may be permitted to pass between the lower housing 324 and the support member 340 into the smaller diameter portion 352 and the upper internal space 326 (e.g., via the passage 338), as indicated by arrows 319. Thus, when the explosive charge 378, 379 separates the support member 340, the hydrostatic pressure may be permitted to move the head 342 and thereby permit the wellbore fluid to flood the upper internal space 326 of the release tool 300. The wellbore fluid may also flood the lower internal space 328, for example, via the internal space 341 (which is now open to the upper internal space 326) and/or the passage 365.

Even if the explosive charge 378, 379 does not fully separate the shank 344 of the support member 340, the internal tension applied to the shank 344 by the downward force caused by the hydrostatic pressure within the exposed internal space 361 may be operable to fully separate a partially severed shank 344. For example, when detonated, the explosive charge 378, 379 may create a split, crack, or cavity extending into or at least partially through the shank 344, decreasing the cross-sectional area and, thus, weakening the shank 344. The decreased cross-sectional area may increase internal stress along the shank 344, permitting the internal tension to fully separate the shank 344.

Flooding the upper internal space 326 of the release tool 300 may equalize pressure within the internal space 326 with the pressure external to the release tool 300, eliminating any pressure differential (or vacuum) that may cause the connector subs 302, 304 to be forced toward each other and, thus, held (i.e., stuck) together. Accordingly, after the internal space 326 is flooded by the wellbore fluid to equalize the pressure within the internal space 326 with the hydrostatic wellbore pressure, the connector subs 302, 304 may be separated from each other.

The inrush of the wellbore fluid into the internal space 326 may at least partially separate or move the connector sub 302 from within the lower connector sub 304. However, friction between the lower portion 383 of the connector sub 302 and the upper portion 384 of the connector sub 304, such as caused by the fluid seals 385 and/or metal-to-metal contact, may cause the connector subs 302, 304 not to fully separate when the explosive charge 378, 379 severs the shank 344 of the support member 340. Accordingly, the biasing member 392 may be installed to fully separate the connector subs 302, 304. When compressed between the shoulders 388, 390, the biasing member 392 may apply an expansion force to both the connector subs 302, 304, thereby biasing the connector subs 302, 304 in opposing directions, as indicated by the arrows 329. Such expansion force may overcome the friction between the connector subs 302, 304 and push the connector sub 302 in the upward direction out of the connector sub 304, as indicated by arrow 336, until the biasing member 392 fully expands and moves the connector sub 302 a distance sufficient to bypass sources of friction between the connector subs 302, 304, such as caused by the fluid seals 385 and/or interference fit (metal-to-metal) contact. FIG. 7 shows the release tool 300 in the fully separated position (third release tool position or third position), when the biasing member 392 is expanded and the lower portion 383 of the connector sub 302 is disconnected from (or not in contact with) the upper portion 384 of the connector sub 304.

The electrical conductor 323 may be severed by the blast caused by the explosive charge 378, 379 or when the connector sub 302 is separated from the connector sub 304. After the support member 340 is severed, tension may be applied to the tool string 110 by one or more of the conveyance devices 140, 144 at the wellsite surface 104 to retrieve the free upper portion 116 of the tool string 110 and the upper connector sub 302 to the wellsite surface 104 while the lower connector sub 304 and the stuck lower portion 118 of the tool string 110 remains downhole in the wellbore 102. Thus, the upper connector sub 302 may be or comprise a removable connector sub and the lower connector sub 304 may be or comprise a remaining connector sub.

The lower connector sub 304 left behind in the wellbore 102 may comprise means for engaging or coupling with wellbore fishing equipment (not shown), which may be deployed downhole when the free upper portion 116 of the tool string 110 is returned to the wellsite surface 104. The fishing equipment may be operable to locate and couple with the connector sub 304 in order to retrieve the stuck lower portion 118 of the tool string 110. The connector sub 304 may comprise internal or external features, such as may permit the connector sub 304 to be coupled with the wellbore fishing equipment during fishing operations. For example, the lower housing 324 of the connector sub 304 may comprise one or more external cavities, protrusions, or other profiles (e.g., an external fishing neck) operable for coupling with the wellbore fishing equipment (e.g., an outside grappling device) during fishing operations. However, the connector sub 304 may comprise a substantially smooth or uniform outer surface, such as may permit the connector sub 304 to be received or captured by an overshoot fishing tool (i.e., an external catch) during fishing operations. The connector sub 304 may also or instead comprise one or more internal cavities, protrusions, or other profiles (e.g., an internal fishing neck profile), which may be exposed when the connector sub 302 is removed and permit the fishing equipment (e.g., an inside grappling device, a spear) to enter and thread into or otherwise latch against the internal profile during fishing operations.

One or more of the release tools (e.g., the release tools 114, 300) according to one or more aspects of the present disclosure may further comprise one or more features and/or modes of operation of the release tools described in U.S. patent application Ser. No. 15/776,022, filed on May 14, 2018, and U.S. patent application Ser. No. 16/004,405, filed on Jun. 10, 2018. The entire disclosures of the aforementioned U.S. Patent Applications are hereby incorporated herein by reference.

In view of the entirety of the present disclosure, including the figures and the claims, a person having ordinary skill in the art will readily recognize that the present disclosure introduces an apparatus comprising a downhole tool for connecting and selectively disconnecting within a wellbore a first portion of a downhole tool string and a second portion of the downhole tool string, wherein the downhole tool comprises: a first connector sub configured for connection with the first portion of the downhole tool string; a second connector sub configured for connection with the second portion of the downhole tool string; a support member connecting the first connector sub and the second connector sub, wherein the second connector sub and the support member collectively define an internal space; and an explosive assembly. The explosive assembly comprises: an explosive charge; a detonator switch operable to detonate the explosive charge; and a housing assembly containing the explosive charge and the detonator switch, wherein the explosive assembly is disposed within the internal space, and wherein the explosive charge is operable to sever the support member when the explosive charge is detonated by the detonator switch to therefore disconnect the first connector sub and the second connector sub from each other and thus disconnect the first portion of the downhole tool string and the second portion of the downhole tool string from each other.

The support member may comprise an elongated body extending between and connecting the first connector sub and the second connector sub. A portion of the internal space may extend within the elongated body. The explosive assembly may be disposed within the internal space such that the explosive charge is disposed within the support member.

The explosive assembly may be disposed within the internal space such that the explosive charge is disposed within the support member.

The housing assembly may comprise a first housing portion, containing the explosive charge, and a second housing portion, containing the detonator switch, wherein the first and second housing portions may be detachably connected. The first and second housing portions may be flexibly connected such that the first and second housing portions may be able to move a limited axial distance with respect to each other.

The downhole tool may comprise an electrical path operable to electrically connect the first and second portions of the downhole tool string with each other when the downhole tool connects the first and second portions of the downhole tool string, wherein the explosive assembly may comprise a portion of the electrical path. In such implementations, among others within the scope of the present disclosure: the explosive assembly may further comprise first and second electrical contacts each supported by the housing assembly; the detonator switch may be electrically connected with the first and second electrical contacts; and the detonator switch and the first and second electrical contacts may each comprise a portion of the electrical path.

The present disclosure also introduces an apparatus comprising an explosive assembly for a downhole tool operable within a wellbore to connect and selectively disconnect a first portion of a downhole tool string and a second portion of the downhole tool string, wherein the explosive assembly comprises: an explosive charge; a detonator switch operable to detonate the explosive charge; and a housing assembly containing the explosive charge and the detonator switch, wherein the explosive assembly is movable as a single unit and installable within an internal space of the downhole tool, and wherein the explosive charge is operable to sever a support member of the downhole tool when the explosive charge is detonated by the detonator switch to therefore disconnect a first portion of the downhole tool and a second portion of the downhole tool from each other and thus disconnect the first and second portions of the downhole tool string.

The explosive assembly may be installable within the internal space of the downhole tool such that the explosive charge is disposed within the support member of the downhole tool connecting together the first and second portions of the downhole tool.

The explosive assembly may be slidably insertable into the internal space of the downhole tool such that the explosive charge is disposed within the support member.

The housing assembly may be configured to threadedly connect with the support member to thereby maintain the explosive charge disposed within the support member.

The housing assembly may comprise a first housing portion, containing the explosive charge, and a second housing portion, containing the detonator switch, wherein the first and second housing portions are detachably connected. The first and second housing portions may be flexibly connected such that the first and second housing portions may be able to move a limited axial distance with respect to each other.

The explosive assembly may comprise an electrical contact supported by the housing assembly, the detonator switch may be electrically connected with the electrical contact, and the electrical contact may be configured to contact a corresponding electrical contact supported by a housing of the downhole tool when the explosive assembly is installed within the internal space of the downhole tool.

The explosive assembly may comprise first and second electrical contacts each supported by the housing assembly; the detonator switch may be electrically connected with the first and second electrical contacts; the first electrical contact may be configured to contact a third electrical contact supported by a housing of the downhole tool when the explosive assembly is installed within the internal space of the downhole tool; and the second electrical contact may be configured to contact a fourth electrical contact supported by the housing of the downhole tool when the explosive assembly is installed within the internal space of the downhole tool. In such implementations, among others within the scope of the present disclosure, the first electrical contact of the explosive assembly may extend circumferentially around the housing assembly.

The present disclosure also introduces a method comprising installing an explosive assembly within a downhole release tool, wherein the explosive assembly comprises: a housing assembly; an explosive charge disposed within the housing assembly; and a detonator switch disposed within the housing assembly and operable to detonate the explosive charge. Installing the explosive assembly within the downhole release tool comprises inserting the explosive assembly as a single unit within an internal space of the downhole release tool. The method also comprises, when the downhole release tool is connected between a first portion of a downhole tool string and a second portion of the downhole tool string and the downhole tool string is conveyed within a wellbore, transmitting a control signal to the detonator switch to detonate the explosive charge to sever the support member to therefore disconnect a first portion of the downhole release tool and a second portion of the downhole release tool from each other and thus disconnect the first portion of the downhole tool string and the second portion of the downhole tool string from each other.

Installing the explosive assembly within the downhole release tool may comprise inserting the explosive assembly within the internal space of the downhole release tool such that the explosive charge is disposed within the support member.

Installing the explosive assembly within the downhole release tool may further comprise rotating the explosive assembly to threadedly connect the housing assembly to the support member to thereby maintain the explosive assembly within the internal space.

The explosive assembly may comprise an electrical contact supported by the housing assembly; the detonator switch may be electrically connected with the electrical contact; and installing the explosive assembly within the downhole release tool may comprise inserting the explosive assembly within the internal space of the downhole release tool such that the electrical contact contacts the electrical contact.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the scope of the present disclosure, and that they may make various changes, substitutions and alterations herein without departing from the scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

What is claimed is:

1. An apparatus comprising:

a downhole tool for connecting and selectively disconnecting within a wellbore a first portion of a downhole tool string and a second portion of the downhole tool string, wherein the downhole tool comprises:

a first connector sub configured for connection with the first portion of the downhole tool string;

a second connector sub configured for connection with the second portion of the downhole tool string, wherein the second connector sub comprises an inner surface;

an inner electrical interface along the inner surface of the second connector sub, wherein the inner electrical interface is connected to a first electrical conductor;

a support member connecting the first connector sub and the second connector sub, wherein the support member comprises an inner surface, and wherein the inner surface of the support member and the inner surface of the second connector sub collectively define an internal space; and an explosive assembly comprising:

an explosive charge;

a detonator switch operable to detonate the explosive charge;

a housing assembly containing the explosive charge and the detonator switch, wherein the housing assembly comprises an outer surface; and an outer electrical interface along the outer surface of the housing assembly, wherein the outer electrical interface is connected to the detonator switch via a second electrical conductor, wherein the explosive assembly is disposed within the internal space such that the explosive charge is disposed within the support member and the inner electrical interface contacts the outer electrical interface, and wherein the explosive charge is operable to sever the support member when the explosive charge is detonated by the detonator switch to therefore disconnect the first connector sub and the second connector sub from each other and thus disconnect the first portion of the downhole tool string and the second portion of the downhole tool string from each other.

2. The apparatus of claim 1 wherein:

the housing assembly comprises a first housing portion containing the explosive charge;

the housing assembly comprises a second housing portion containing the detonator switch; and the first housing portion and the second housing portion are flexibly connected such that the first housing portion and the second housing portion can move a limited axial distance with respect to each other.

3. The apparatus of claim 1 wherein the detonator switch is operable to receive a control signal transmitted from a wellsite surface that causes the detonator switch to detonate the explosive charge.

4. The apparatus of claim 1 wherein the inner electrical interface extends circumferentially along the inner surface of the second connector sub, and wherein the outer electrical interface extends circumferentially along the outer surface of the housing assembly.

5. The apparatus of claim 1 wherein:

the outer electrical interface is a first outer electrical interface;

the explosive assembly further comprises a second outer electrical interface along the outer surface of the housing assembly; and the second outer electrical interface is connected to the detonator switch via a third electrical conductor.

6. The apparatus of claim 5 wherein:

the inner electrical interface along the inner surface of the second connector sub is electrically insulated from the second connector sub; and the explosive assembly is disposed within the internal space such that the second inner electrical interface contacts the inner surface of the second connector sub to establish an electrical ground.

7. The apparatus of claim 1 wherein:

the downhole tool further comprises an upper electrical interface configured to contact an electrical interface of the first portion of the downhole tool string; and the upper electrical interface is connected to the first electrical conductor.

8. An apparatus comprising:

an explosive assembly for a downhole tool operable to connect and selectively disconnect within a wellbore a first portion of a downhole tool string and a second portion of the downhole tool string, wherein the explosive assembly comprises:

an explosive charge;

a detonator switch operable to detonate the explosive charge;

a housing assembly containing the explosive charge and the detonator switch, wherein the housing assembly comprises an outer surface; and an outer electrical interface along the outer surface of the housing assembly, wherein the outer electrical interface is connected to the detonator switch via an electrical conductor extending through the housing assembly, wherein the explosive assembly is movable as a single unit and insertable within an internal space of the downhole tool such that the outer electrical interface contacts an inner electrical interface along an inner surface of the downhole tool, and wherein the explosive charge is operable to sever a support member connecting together a first portion of the downhole tool and a second portion of the downhole tool when the explosive charge is detonated by the detonator switch to therefore disconnect the first portion of the downhole tool and the second portion of the downhole tool from each other and thus disconnect the first portion of the downhole tool string and the second portion of the downhole tool string from each other.

9. The apparatus of claim 8 wherein the detonator switch is operable to receive a control signal transmitted from a wellsite surface that causes the detonator switch to detonate the explosive charge.

10. The apparatus of claim 8 wherein the explosive assembly is insertable within the internal space of the downhole tool such that the explosive charge is disposed within the support member.

11. The apparatus of claim 8 wherein the housing assembly comprises external threads configured to threadedly connect with internal threads of the support member to thereby connect the explosive assembly to the support member.

12. The apparatus of claim 8 wherein:

the housing assembly comprises a first housing portion containing the explosive charge;

the housing assembly comprises a second housing portion containing the detonator switch; and the first housing portion and the second housing portion are flexibly connected such that the first housing portion and the second housing portion can move a limited axial distance with respect to each other.

13. The apparatus of claim 8 wherein the outer electrical interface extends circumferentially along the outer surface of the housing assembly.

14. The apparatus of claim 8 wherein:

the outer electrical interface is a first outer electrical interface;

the explosive assembly further comprises a second outer electrical interface along the outer surface of the housing assembly; and the second outer electrical interface is connected to the detonator switch via another electrical conductor extending through the housing assembly.

15. The apparatus of claim 14 wherein the explosive assembly is insertable within the internal space of the downhole tool such that the second inner electrical interface contacts the inner surface of the second portion of the downhole tool to establish an electrical ground.

16. The apparatus of claim 14 wherein the second outer electrical interface extends circumferentially along the outer surface of the housing assembly.

17. A method comprising:

installing an explosive assembly within a downhole release tool, wherein the explosive assembly comprises: a housing assembly; an explosive charge disposed within the housing assembly; an outer electrical interface along an outer surface of the housing assembly; and a detonator switch disposed within the housing assembly and operable to detonate the explosive charge, wherein the detonator switch is electrically connected with the outer electrical interface, and wherein installing the explosive assembly within the downhole release tool comprises inserting the explosive assembly as a single unit within an internal space of the downhole release tool such that the outer electrical interface contacts an inner electrical interface along an inner surface of the downhole release tool; and when the downhole release tool is connected between a first portion of a downhole tool string and a second portion of the downhole tool string and the downhole tool string is conveyed within a wellbore, transmitting from a wellsite surface a control signal to the detonator switch to detonate the explosive charge to sever a support member connecting together a first portion of the downhole release tool and a second portion of the downhole release tool to therefore disconnect the first portion of the downhole release tool and the second portion of the downhole release tool from each other and thus disconnect the first portion of the downhole tool string and the second portion of the downhole tool string from each other.

18. The method of claim 17 wherein installing the explosive assembly within the downhole release tool further comprises inserting the explosive assembly within the internal space of the downhole release tool such that the explosive charge is disposed within the support member.

19. The method of claim 17 wherein installing the explosive assembly within the downhole release tool further comprises rotating the explosive assembly to threadedly connect the housing assembly to the support member to thereby maintain the explosive assembly within the internal space.

20. The method of claim 17 wherein the outer electrical interface extends circumferentially along the outer surface of the housing assembly.

* * * * *